US005670014A

United States Patent [19]

Mendelovich et al.

[11] Patent Number: 5,670,014

[45] Date of Patent: Sep. 23, 1997

[54] TAPE DISPENSING APPLICATOR AND REPLACEABLE TAPE CARTRIDGE

[75] Inventors: Isaac Mendelovich, Elkins Park; Peter W. Bressler; John D. Coleman, both of Philadelphia; Jason L. Williams, Erie, all of Pa.

[73] Assignee: Tapelicator, Inc., Philadelphia, Pa.

[21] Appl. No.: 672,355

[22] Filed: Jun. 25, 1996

Related U.S. Application Data

[63] Continuation-in-part of Ser. No. 324,552, Oct. 18, 1994, and Ser. No. 616,609, Mar. 15, 1996.

[51] Int. Cl.[6] ..... B32B 31/00

[52] U.S. Cl. ..... 156/523; 156/574; 156/577; 156/579

[58] Field of Search ..... 156/523, 530, 156/540, 574, 577, 579

[56] References Cited

U.S. PATENT DOCUMENTS

| | | | |
|---|---|---|---|
| 496,607 | 2/1893 | Stevenson . | |
| 2,511,857 | 6/1950 | Fritzinger . | |
| 2,676,765 | 4/1954 | Kaplan . | |
| 2,868,402 | 1/1959 | Perry . | |
| 3,125,263 | 3/1964 | Harbour . | |
| 3,306,806 | 2/1967 | Seropian . | |
| 3,329,326 | 7/1967 | Simon . | |
| 3,523,053 | 8/1970 | Zbinden et al. . | |
| 3,725,182 | 4/1973 | Regan . | |
| 3,745,086 | 7/1973 | Parker . | |
| 4,238,271 | 12/1980 | Urushizaki | 156/523 |
| 4,341,587 | 7/1982 | Regan . | |
| 4,344,813 | 8/1982 | Holoff et al. . | |
| 4,345,966 | 8/1982 | Iiyama et al. . | |
| 4,511,427 | 4/1985 | Karliner et al. | 156/523 |
| 4,591,407 | 5/1986 | Samuelson . | |
| 4,704,185 | 11/1987 | Fischer . | |
| 4,792,375 | 12/1988 | Lin | 156/530 X |
| 4,804,437 | 2/1989 | Tirtoprodjo et al. | 156/579 X |
| 5,073,228 | 12/1991 | Lin . | |
| 5,076,883 | 12/1991 | Bosley | 156/577 X |
| 5,512,128 | 4/1996 | Manusch et al. | 156/540 X |

OTHER PUBLICATIONS

D.L. Pierson, "Label Attachment Machine", IBM Technical Disclosure Bulletin 2257, vol. 18, No. 7, Dec. 1975.

*Primary Examiner*—James Engel

*Attorney, Agent, or Firm*—Panitch Schwarze Jacobs & Nadel, P.C.

[57] ABSTRACT

An applicator for dispensing tape, with the tape having an adhesive on at least one face. The applicator includes a shell with a pivotably attached door. A tape cartridge is received within the door. The cartridge supports a roll of the tape, and a leading edge of the tape extends outwardly from the roll. A partial cylindrical cover member is connected to the first end of the shell for pivotable movement thereabout along a predetermined path to cover the a first passageway. A slider having a first end which is pivotally connected to the cover member and having a button which extends through a first slot in the shell is movable between a first position, in which the cover member covers the first passageway, and a second position, in which the cover member is removed from the first passageway. A cutter actuator is located on the slider and is movable in response to inward pressure on the button when the slider is in the second position. A cutting tool is pivotally connected to the shell. The cutting tool is movable from a first position to a second position, in which the cutting instrument extends through the first passageway, by the application of inward pressure to the button on the slider.

20 Claims, 20 Drawing Sheets

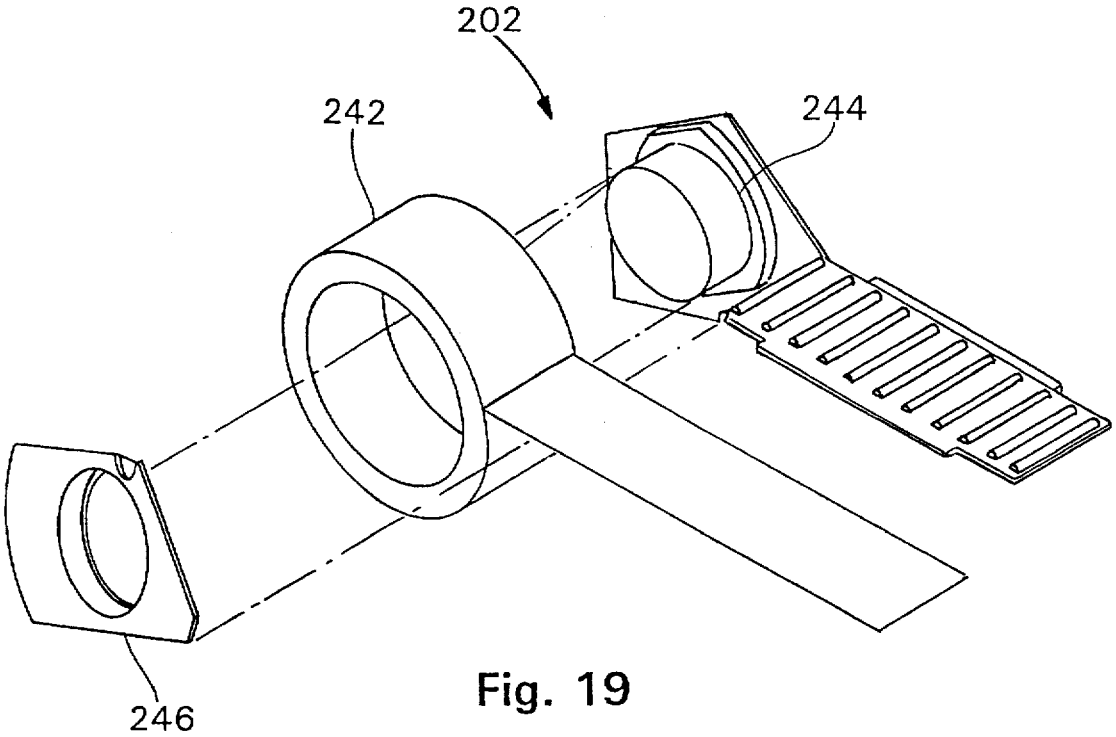
Fig. 19
Fig. 20
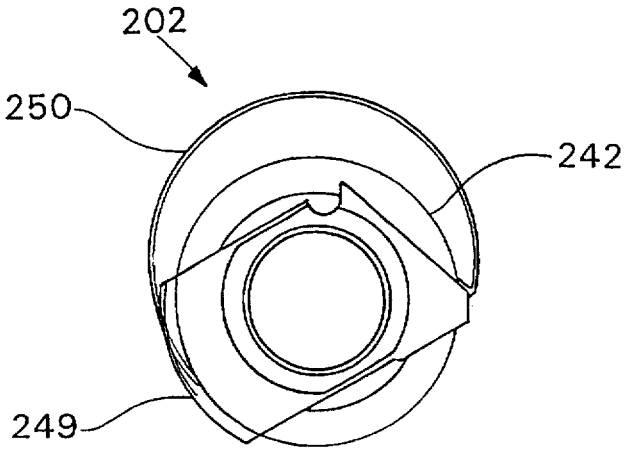

TAPE DISPENSING APPLICATOR AND REPLACEABLE TAPE CARTRIDGE

CROSS-REFERENCE TO RELATED APPLICATION

This application is a continuation-in-part of provisional application No. 60/002,643, filed Aug. 22, 1995, which is a continuation-in-part of application No. 08/324,552, filed Oct. 18, 1994, and is also a continuation-in-part of application No. 08/616,609, filed Mar. 15, 1996.

FIELD OF THE INVENTION

This invention relates to a tape dispensing applicator, and more particularly, to applicators shaped and sized to be conveniently used by a single hand of a user and which only expose tape when it is to be dispensed to a surface. The invention also relates to replaceable cartridges usable with the tape applicators.

BACKGROUND OF THE INVENTION

In today's academia, the price of school books is not inconsequential. Typically, students purchase the books and then use highlighters to indicate the subject matter of the book which is important to their course of study. Unfortunately, this method for highlighting the important subject matter is problematic because it permanently scars or defaces the book and prevents the book from readily being resold to subsequent students for reuse. Hence, there exists a need for allowing a student to easily mark a book without permanently scaring the book to allow the student to resell the book as though it was nearly new.

The need to avoid permanently defacing a document is not limited to academia, but also is applicable to the home and office because highlighters are commonly used to permanently mark items or documents. The permanent marking of documents is sometimes avoided by the use of applicators that place a removable label on the document itself. Furthermore, in office applications, a correction or cover tape may be used to cover up indicia placed on the exterior of a container so as to allow that container to be reused for storage of other documents or on documents that need to be redated prior to copying.

An applicator that dispenses tape to serve as a highlighting function, yet to be removably applied to a surface so as not to destroy the printed page, is described in U.S. Pat. No. 5,076,883 of Bosley. The dispenser of Bosley has a tubular shape which may have some drawbacks with regard to its maneuverability, especially when compared with the shape of a contoured instrument, such as an easily grippable and maneuverable writing instrument having a contoured shape. The difficulty of manipulating a tubular device may be particularly experienced by children, older users or individuals with a handicap that impairs their motor control skills. In addition, to its disadvantage with regard to its manipulation, the dispenser of Bosley leaves its tape exposed to the environment. Such exposure may allow contaminates to find their way onto the adhesive tape and, thereby, hinder the adhesion of the tape to the surface of interest.

The prior art indicated by the aforementioned reference describing an applicator seems to suffer from the drawbacks of not providing a closed environment when its tape is not being used so as to prevent any contaminates from finding their way thereon and also for not providing a contoured shape that is more amenable to that desired for a writing instrument so that the applicator may be easily manipulated by all of its users, even those suffering from motor skills deficiencies.

There is also a problem for dispensing any adhesive-backed material in a one handed operation. Generally, the user must pull the adhesive-backed material from the end of the holder in order to start the application of the material. This can introduce dirt or debris onto the adhesive surface, as well as get adhesive on the user's fingers. Refilling and starting a roll of new adhesive-backed material is also problematic in this respect requiring handling of the adhesive surface in many instances. Additionally, once the adhesive-backed material is applied, a portion of the material remaining on the holder/dispenser remains exposed, and can pick-up dust or debris.

SUMMARY OF THE INVENTION

Briefly stated, the present invention provides an applicator for dispensing tape having an adhesive on at least one face thereof. The applicator comprises a shell having opposite sides, a first end and a second end, the first end including an open region and a first slot. A door is pivotably attached to the shell, and a tape cartridge is received within the door. The cartridge includes means for rotatably supporting a roll of the tape, wherein a leading edge of the tape extends outwardly from the roll. A partial cylindrical cover member having an open portion and a closed portion is located over the open region. The cover member connected to the first end of the shell for pivotable movement thereabout along a predetermined path. A slider is provided having a first end which is pivotally connected to the cover member, and having a button which extends through the first slot in the shell. A cutter actuator is also located on the slider inside the shell. The slider is slidably attached to the shell for sliding movement between a first position, in which the cover member covers the open region of the shell, and a second position, in which the cover member is removed from the open region. The cutter actuator is movable in response to inward pressure on the button. A cutting tool having a support arm with a first end which supports a cutting instrument and a second end which is pivotally connected to the shell is provided. A resilient member biases the support arm to a first position in which the cutting instrument is retracted in the shell. The cutting tool is movable from the first position to a second position by the application of inward pressure to the button on the slider such that the cutter actuator moves the support arm and the cutting instrument extends through the open region of the shell.

BRIEF DESCRIPTION OF THE DRAWINGS

The following detailed description of preferred embodiments will be understood when read in conjunction with the appended claims. Although preferred embodiments are shown in the drawings, it should be understood that the invention is not limited to the precise arrangements and instrumentalities shown in the drawings, which are all diagrammatic:

FIG. 19 shows a method of assembling a tape cartridge employed with the second embodiment of the invention;

FIG. 20 shows an assembled tape cartridge employed with the second embodiment of the invention, as it appears when assembled for shipment;

DETAILED DESCRIPTION OF PREFERRED EMBODIMENTS

Figure 1:
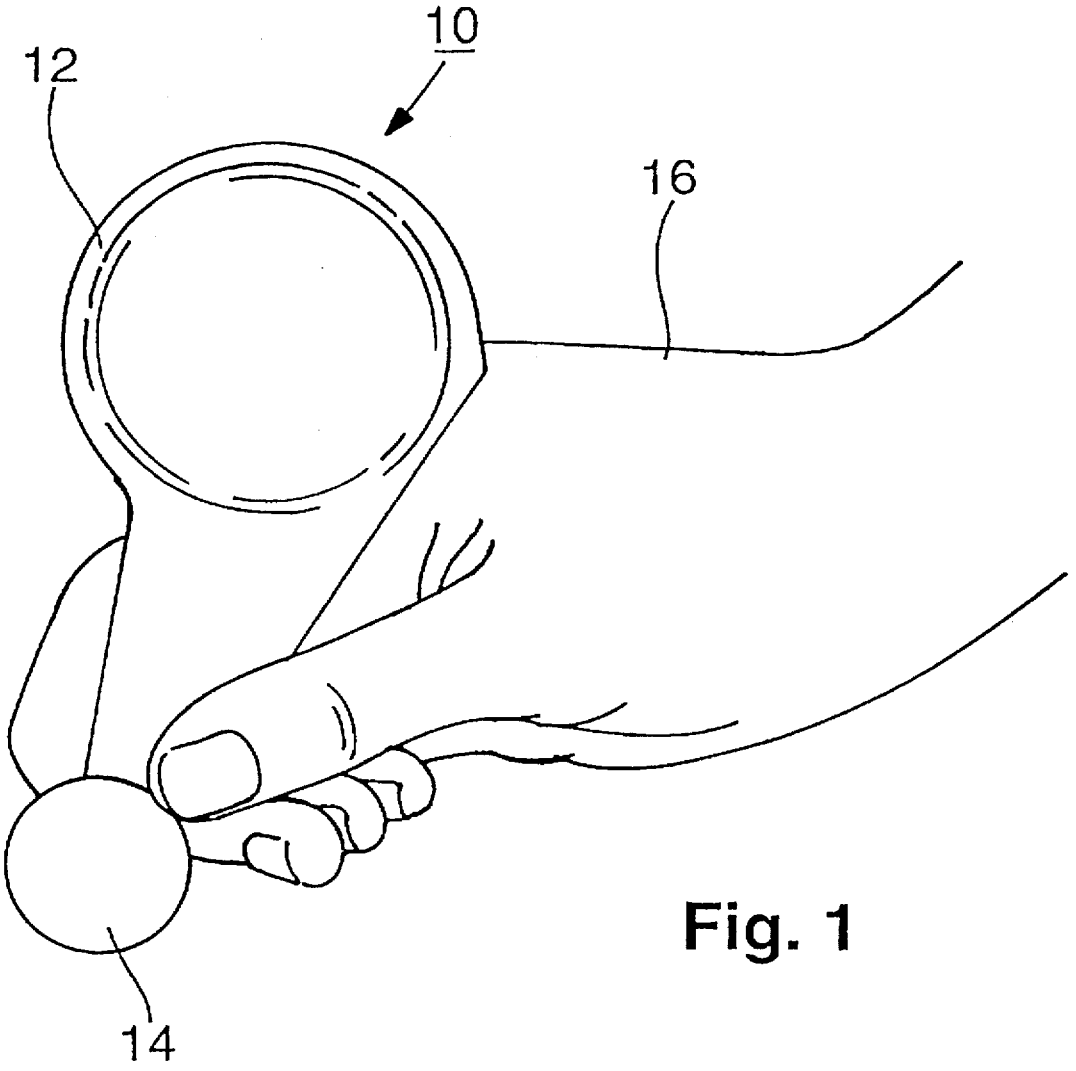
FIG. 1 is a perspective view illustrating a first embodiment of the applicator of the present invention being held and used by a single hand of a user.

In the drawings, like numbers are employed for the indication of like elements.

Referring to the drawings, in particular to FIG. 1, there is shown a first embodiment of an applicator 10 comprising a shell 12 and a cover member 14. The applicator 10 is advantageously shaped, sized and contoured so as to be easily manipulated by the use of a single hand 16 of a user and constructed so as to only expose its associated tape when the tape is to be applied to a surface of interest. Such limited exposure significantly reduces the amount of contaminants that might otherwise find their way onto the adhesive material of the tape and retard its sticking characteristic. The shell 12 and the cover 14, as well as other elements comprising applicator 10 to be further described, are preferably constructed of a plastic or polymeric material to facilitate manufacturing of the applicator 10 by means of a molding process. However, it is to be understood by those skilled in the art, that the elements 12 and 14, as well as other elements, could be constructed of other material, such as wood or metal without departing from the spirit and scope of the invention. These elements 12 and 14, in particular 12, are preferably further shaped, sized and contoured so as to form a conveniently grippable device that may be easily manipulated in a manner similar to a writing instrument, such as a fountain pen. More particularly, this shell 12 is preferably sized to fit within the single hand 16 of a user (as shown in FIG. 1), much like any writing instrument. Shell 12 has opposite sides which may be further described with reference to FIG. 2.

Figures 2A, 2B:
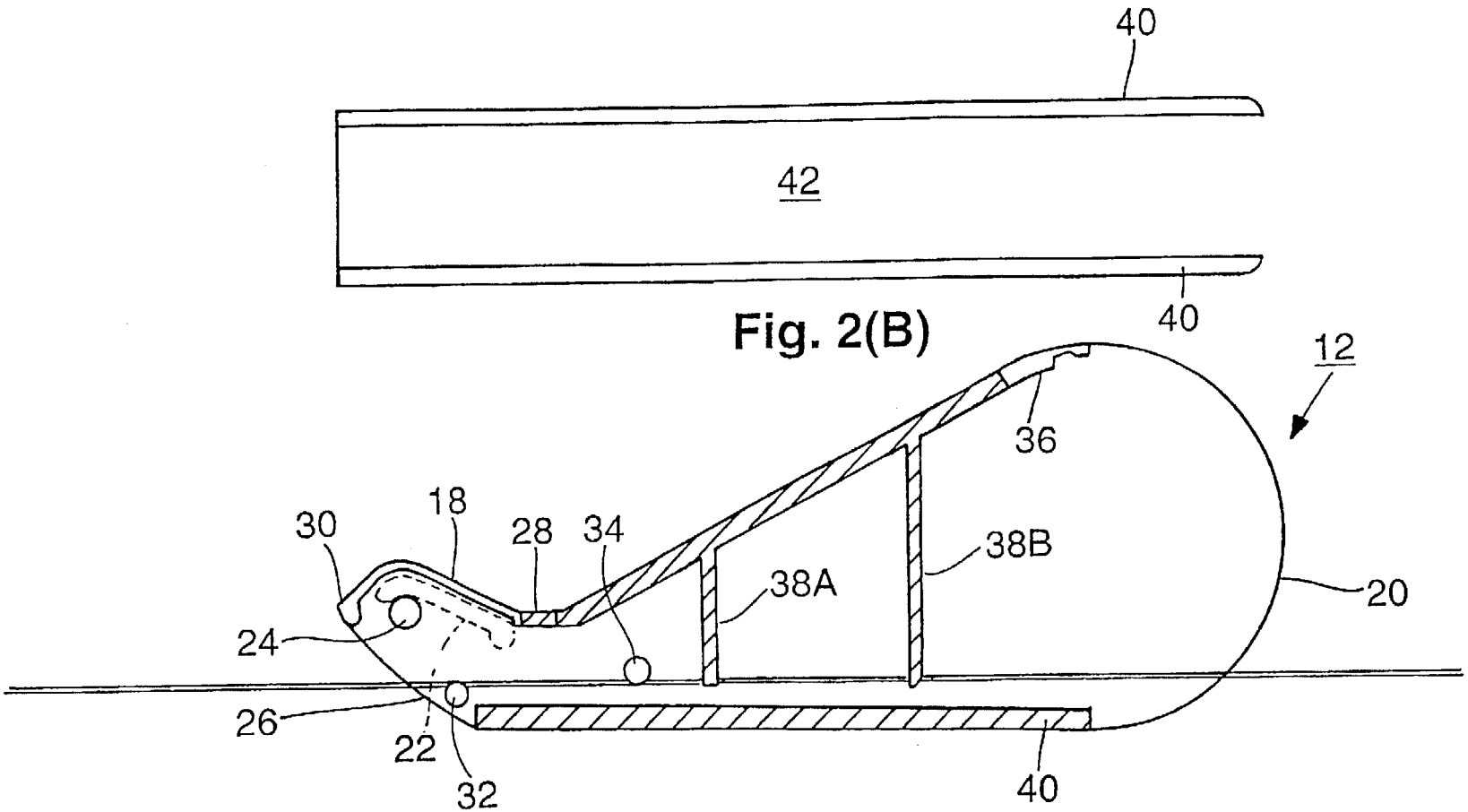
FIG. 2 is composed of FIGS. 2(A) and 2(B) that illustrate details of the shell of the applicator of the first embodiment of the present invention.
Figure 5:
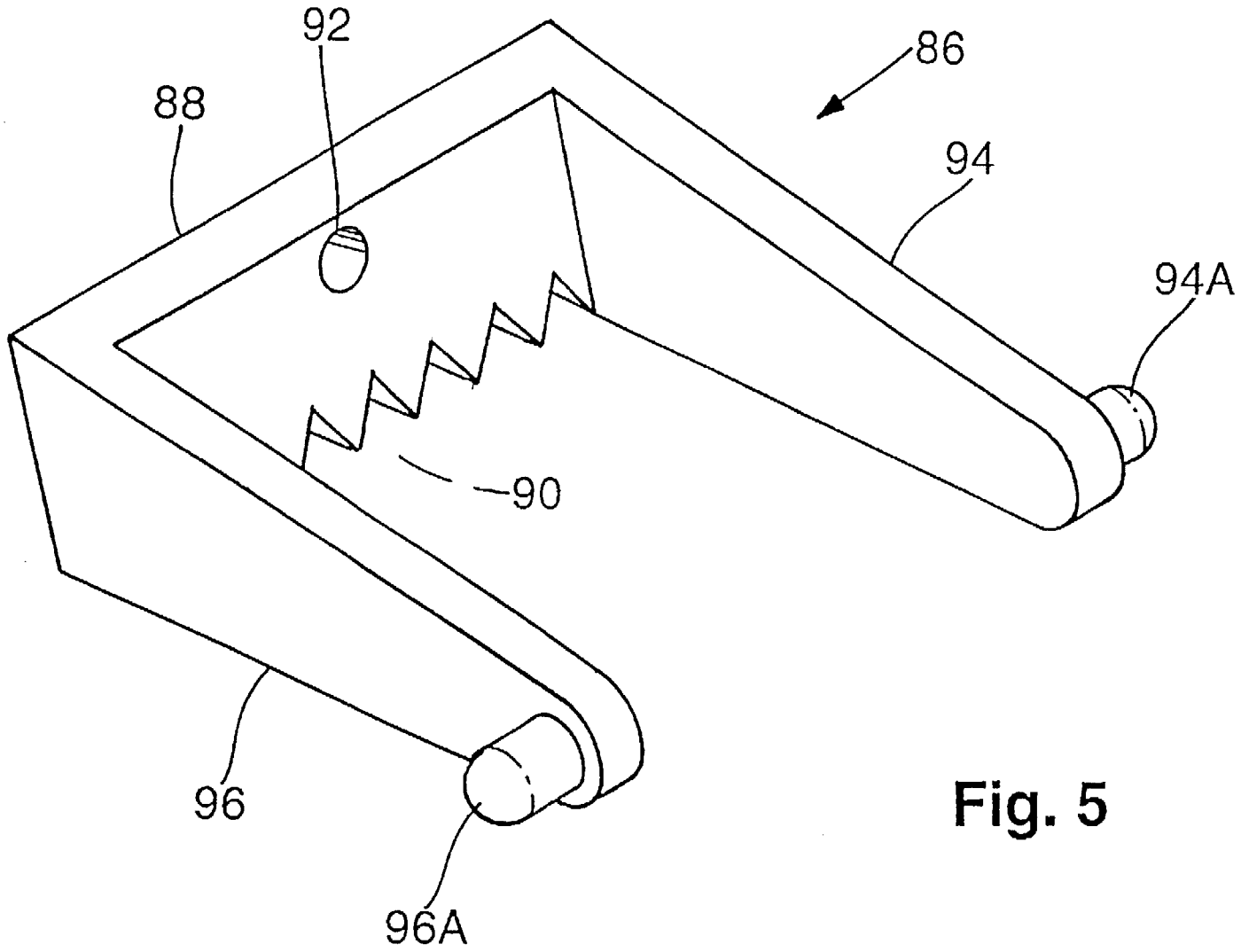
FIG. 5 illustrates the cutting tool of the applicator of the first embodiment of the present invention.
Figure 10:
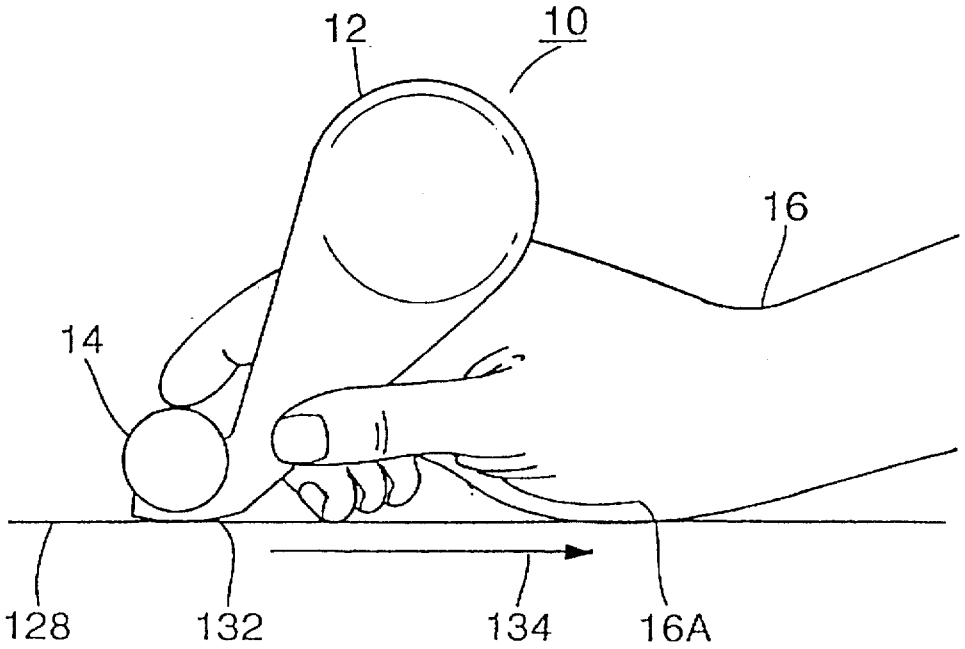
FIGS. 10 and 11 are perspective views showing the use of the applicator of the first embodiment of the present invention respectively applying and cutting the applied tape.
Figure 11:
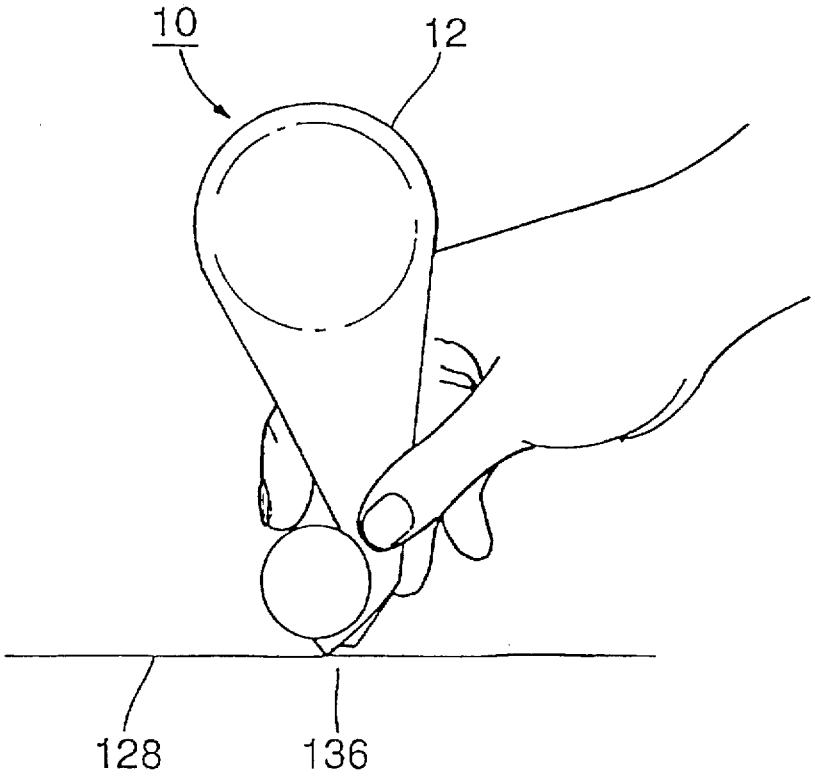

FIG. 2 is composed of FIGS. 2(A) and 2(B), wherein FIG. 2(A) illustrates, in section, one of the opposite sides of the shell 12. Although shell 12 is illustrated as comprising separate opposite sides, in actuality the sides are formed of a single member having an upper contoured portion to facilitate gripping thereof and which brings together or merges the opposite sides. Each of the sides of the shell 12 has first and second ends 18 and 20, respectively. The first end 18 has a first groove 22, shown in phantom, formed in its exterior portion and a first pin 24 affixed in its interior portion. The first end 18 has a first passageway 26 and a second passageway 28, with the first passageway 26 having a lip 30 at its leading edge which, as will be described with reference to FIGS. 10 and 11, is used to establish a stationary position for the applicator 10 prior to its cutting operation. The first end 18 has an opening 32 which serves as a device for mating with a lever member, to be described with reference to FIG. 5, and a second opening 34 which serves as a device for mating with an actuator member, to be described with reference to FIG. 7. The second end 20 has a connection device, which in one embodiment comprises a prong 36. The shell 12 may also comprise stiffening members 38A and 38B. The shell 12 has open slots 40 that form part of a floor shown in FIG. 2(B). It should be noted that the floor 42 represents the lateral dimension of the applicator 10, when the opposite sides of the shell 12 of FIG. 2(A) are merged together. The shell 12 receives a cartridge 44, which may be further described with reference to FIG. 3.

Figures 3A, 3B:
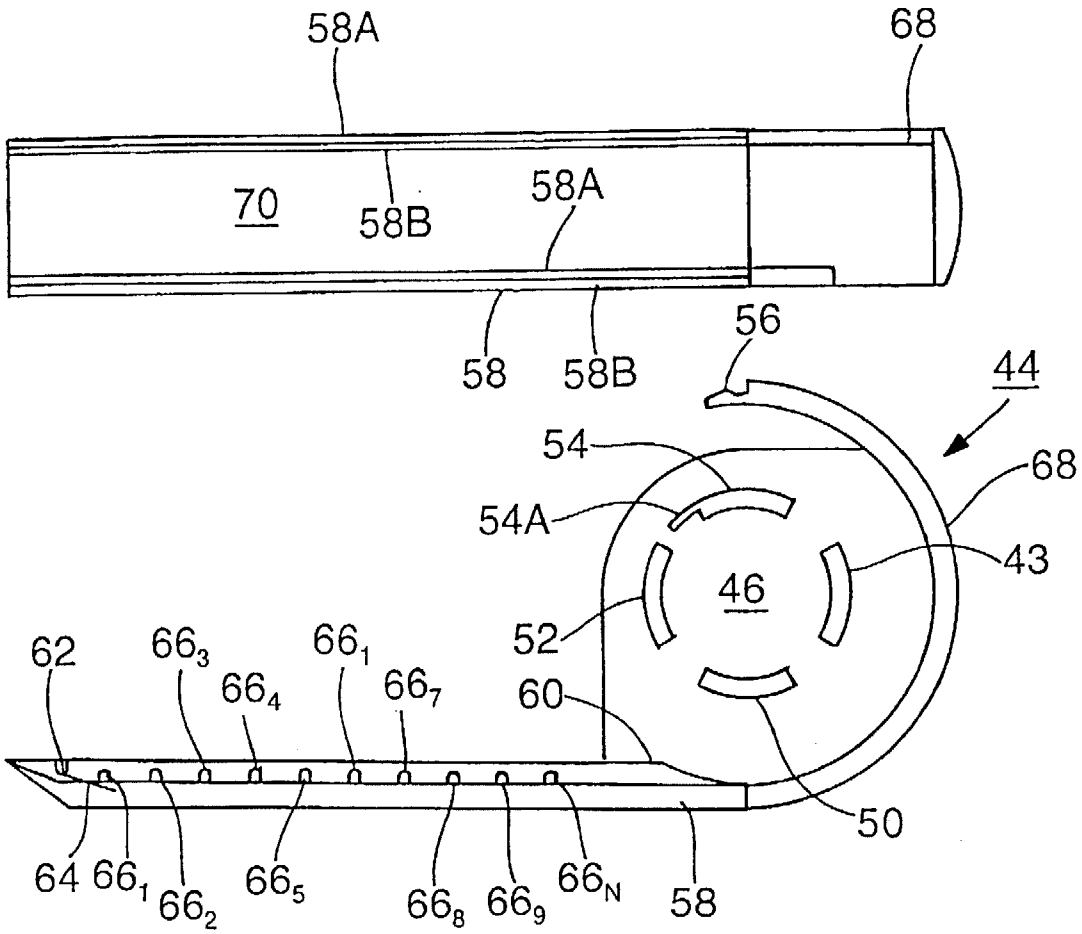
FIG. 3 is composed of FIGS. 3(A) and 3(B) which illustrate details of the cartridge of the applicator of the first embodiment of the present invention.

FIG. 3 is composed of FIGS. 3(A) and 3(B), wherein FIG. 3(A) illustrates, in section, one side of the cartridge 44. As seen in FIG. 3(A), the cartridge 44 has a device 46 for rotatably supporting a roll (not shown, but to be described with reference to FIG. 6) on which the tape, preferably of the adhesive type, is wound. The device 46 comprises partial rim members 48, 50, 52 and 54 that confine the lateral movement of the roll, and wherein the rim portion 54 has an extending member 54A that contacts and retards the ease of movement of the central region of the roll of tape. This retarding acts to prevent the tape from working its way off the roll, especially during transportation of the applicator, which might otherwise create slack in the tape that may undesirably find its way onto and stick to the interior portions of the cartridge 44. The cartridge 44 has a connection device, which for one embodiment, comprises a prong 56 that mates in a manner complementary with the respective prong 36 of the shell 12. The cartridge 44 further has a rail 58 and a tray 60 on which is mounted a plurality of bar members that laterally extend thereacross and one of which is bar member 62 located at the output stage of the cartridge 44 and has a member 64 connected to it which raises it above the other bar members $66_1$, $66_2$, $66_3$, $66_4$, $66_5$, $66_6$, $66_7$, $66_8$, $66_9$ and $66_N$. The bar members 62, $66_1$, . . . $66_N$ may have any shape but preferably have a cylindrical rod configuration. As will be further discussed hereinafter with reference to FIG. 11, the member 62 acts as means for preventing the tape, after being cut, from recoiling back toward its roll, whereas members $66_1$ . . . $66_N$, because of their relatively small surface area, act as means for preventing the adhesive tape, which normally passes thereover, from being undesirably stuck to the inner surface of the cartridge. More particularly, even if the adhesive tape inadvertently and undesirably contacts any of the members $66_1$ . . . $66_N$, the tape is easily released therefrom because of the relatively small surface area of these anti-stick members that contact the adhesive tape. As seen in FIG. 3(B), the rail members 58 are located on each side of the wall 70 of the cartridge 44 and have grooved out sections 58A and 58B which accommodate the insertion of the cartridge 44 into the shell 12. More particularly, the grooved sections 58A and 58B accommodate the insertion of the rails 58 into the open slots 40 of shell 12. The shell 12 also has attached thereto a cover 14 that may be further described with reference to FIG. 4.

Figure 4B:
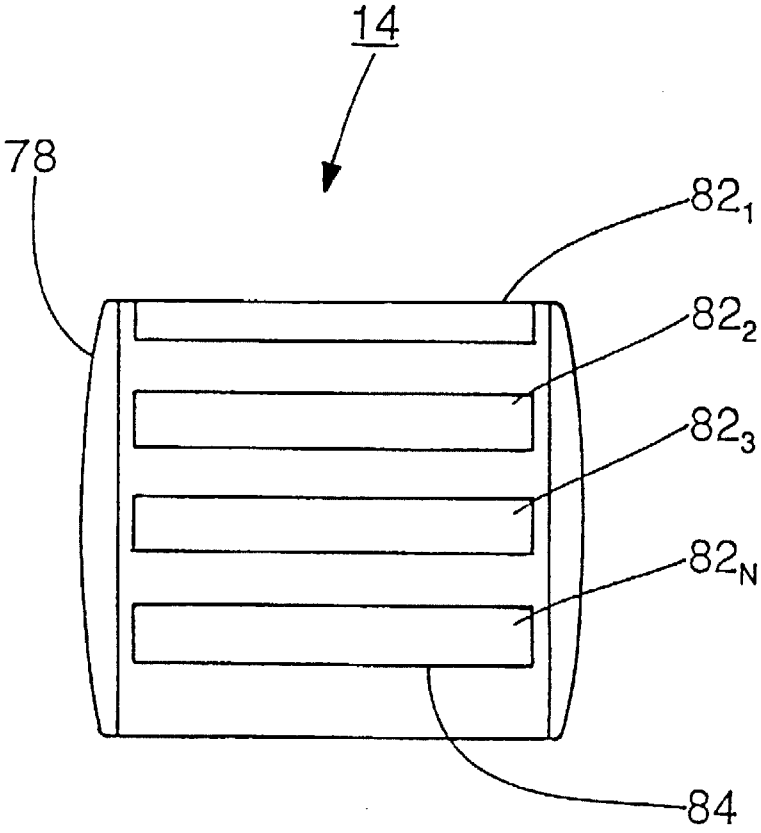
FIG. 4 is composed of FIGS. 4(A) and 4(B) that illustrate details of the cover of the applicator of the first embodiment of the present invention.
Figure 4A:
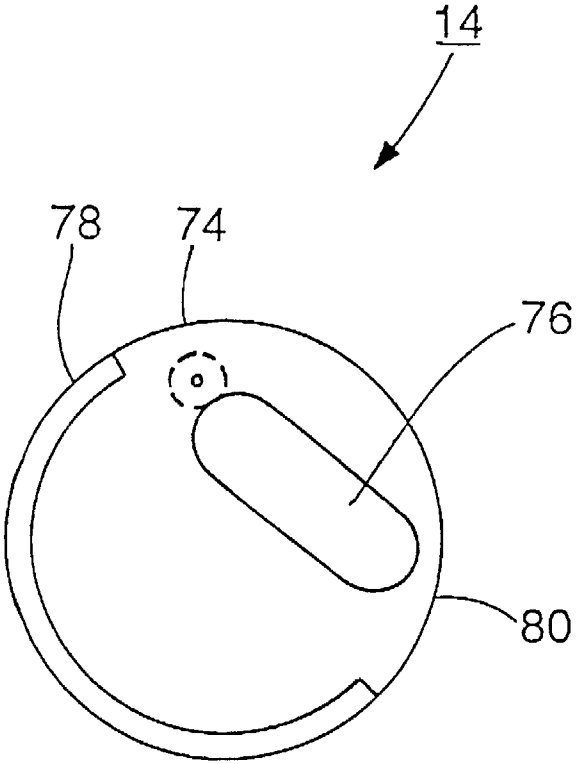

FIG. 4 is composed of FIGS. 4(A) and 4(B), and respectively illustrates a view of the interior of the cover 14 and a top view of a closed portion of the cover 14. As seen in FIG. 4(A), the cover 14 comprises a second pin 74 and a second groove 76. The pin 74 rides in the groove 22 of shell 12, whereas the groove 76 has the pin 24 of shell 12 riding therein. The pin 74 is located and lodged on its outer surface so as to mate with the exterior groove 22 of the shell 12, whereas the groove 76 is located on its inner surface so as to mate with the interior pin 24 of the shell 12. It should be understood that pin 74 and groove 76 of cover 14 are located on opposite sides of the cover 14 so as to cooperatively mate with groove 22 and pin 24 of shell 12. Further, as will be discussed with reference to FIGS. 7–9, these cooperatively acting pins and grooves are shaped and dimensioned so that the cover 14 may smoothly move with respect to the shell 12 in a predetermined path allowing the cover 14 to serve as a control knob for the applicator 10.

The cover 14 comprises a partial cylindrical member 78 that defines an open portion 80, serving as a third passageway, and a closed portion, not shown in FIG. 4(A) but to be described with reference to FIG. 7. As used herein, a partial cylindrical member is meant to represent a member similar to a partial barrel member having a partially closed side and corresponding top and bottom sections at opposite ends of the closed side. As seen in FIG. 4(B), the partial cylindrical member 78 has a plurality of members $82_1$, $82_2$, $82_3$ . . . $82_N$, each protruding from its outer surface. Each of these protrusions $82_1$ . . . $82_N$ allows the operator of applicator 10 to more easily grip and manipulate the cover 14, thereby, allowing the cover 14 to more easily serve as a control knob, as to be described. Further, the protrusion $82_N$ preferably further comprises a non-skid surface 84 which allows the cover 14 to grip the surface to which the adhesive tape is being applied and to assist in the operation of the applicator 10, in a manner to be further described with reference to FIGS. 10 and 11. A cutting tool 86 which primarily assists in the cutting operation performed by the applicator 10 may be further described with reference to FIG. 5.

The cutting tool 86 has a first portion 88 with a leading edge 90 serving as a cutting instrument. The cutting instrument 90 preferably has a sawtooth base and may be comprised of either a plastic or a metal material. The first portion 88 further has an aperture 92 into which is insertable a spring member (not shown) to be described with reference to FIG. 7. The cutting tool 86 has at least one arm but preferably two 94 and 96, both of which serve as lever members and, in one embodiment, have prongs 94A and 96A, respectively, that mate with the lever mating device 32 of the shell 12. In one embodiment, the lever members 94 and 96 may have a thickness of about 0.060 inches, while in another embodiment, this thickness may be increased to about 0.120 inches, which increase provides more surface area to come into contact with the surface to which the tape is being applied which, in turn, spreads the force being applied thereto, so as to act against any scarring thereof. The cutting tool 86 cuts the tape 98 which may be further described with reference to FIG. 6.

Figures 6A, 6B:
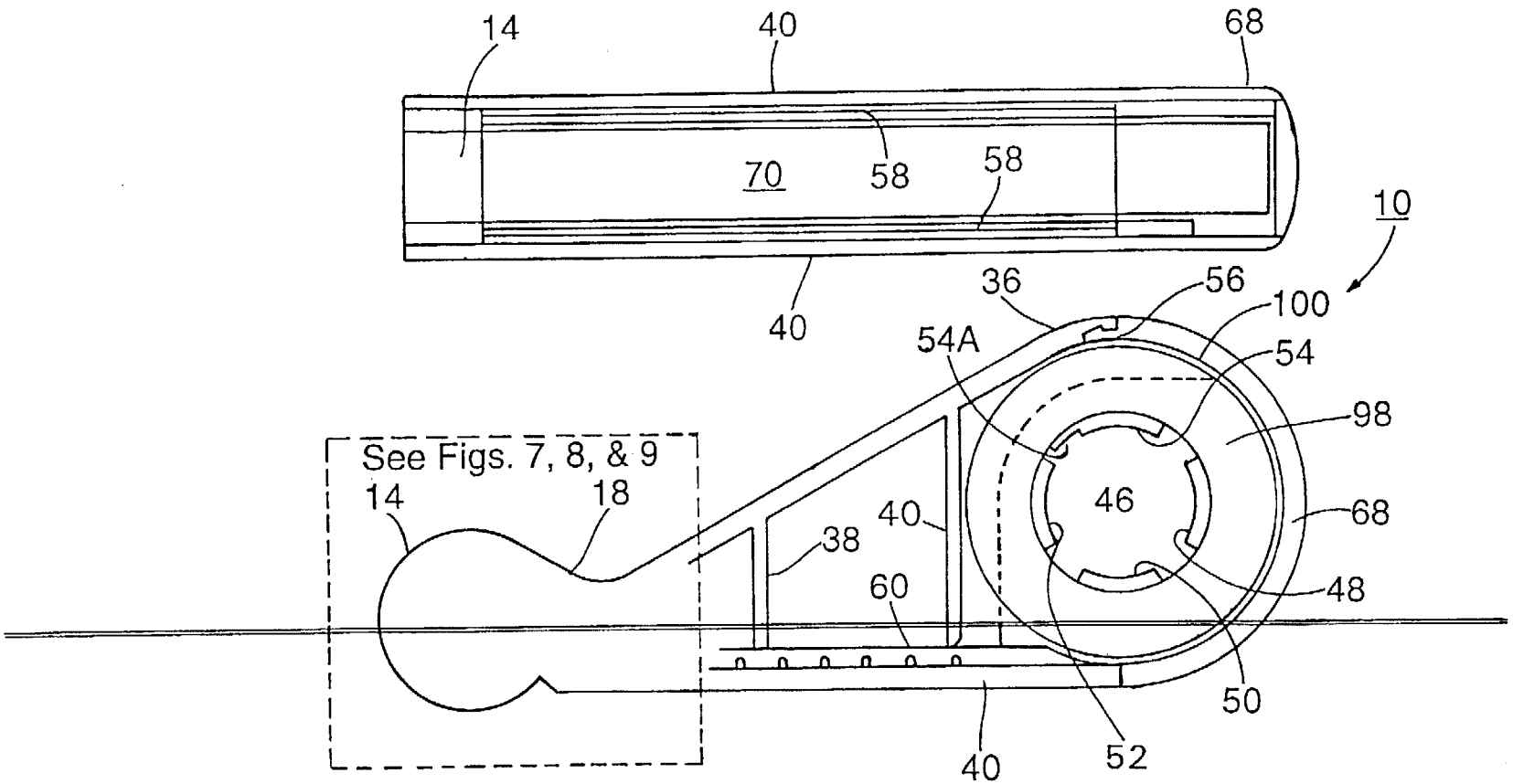
FIGS. 6A and 6B generally illustrate the assembled applicator of the first embodiment of the present invention.

FIG. 6 partially illustrates an assembled applicator 10 and is composed of FIGS. 6(A) and 6(B), wherein FIG. 6(A) illustrates the tape 98 as being wound onto a roll 100 that is placed onto rotatable mounting device 46. The roll 100 and adhesive tape 98 may have various width dimensions varying from 1/16 of an inch to about two inches, and may comprise various colors such as yellow, green or orange, and may be used to accommodate marking, highlighting, labelling and other types of applications commonly provided by an adhesive tape dispenser. Further, the tape may be opaque or transparent, depending upon the use to be made. Further, while tape is described herein, the applicator 10 could be readily used for dispensing ribbon, string or similar material without departing from the spirit and scope of this invention. Further still, the tape 98 may be used for correction purposes for the covering up of a transparent or non-transparent material, or may be of a relatively heavy-gauge material commonly used for packing. The tape 98, arranged within the applicator 10 of the present invention, may find usage in the office, or in school and may be conveniently used by children, adults, as well as those users having motor skill impediments.

As further seen in FIG. 6(A), the prong 56 of the cartridge 44 mates with the prongs 36 of the shell 12. Further, the tray 60 of the cartridge 44 is insertable under the strengthening ribs 38A and 38B of the shell 12. As seen in FIG. 6(B), the rails 58 are inserted into the slots 40 of the shell 12. As seen in FIGS. 6(A) and 6(B), the cover 14 is located at the end 18 of the shell 12 and the cover 14, as well as other elements of the applicator 10, may be fully described with reference to FIG. 7.

Figure 7:
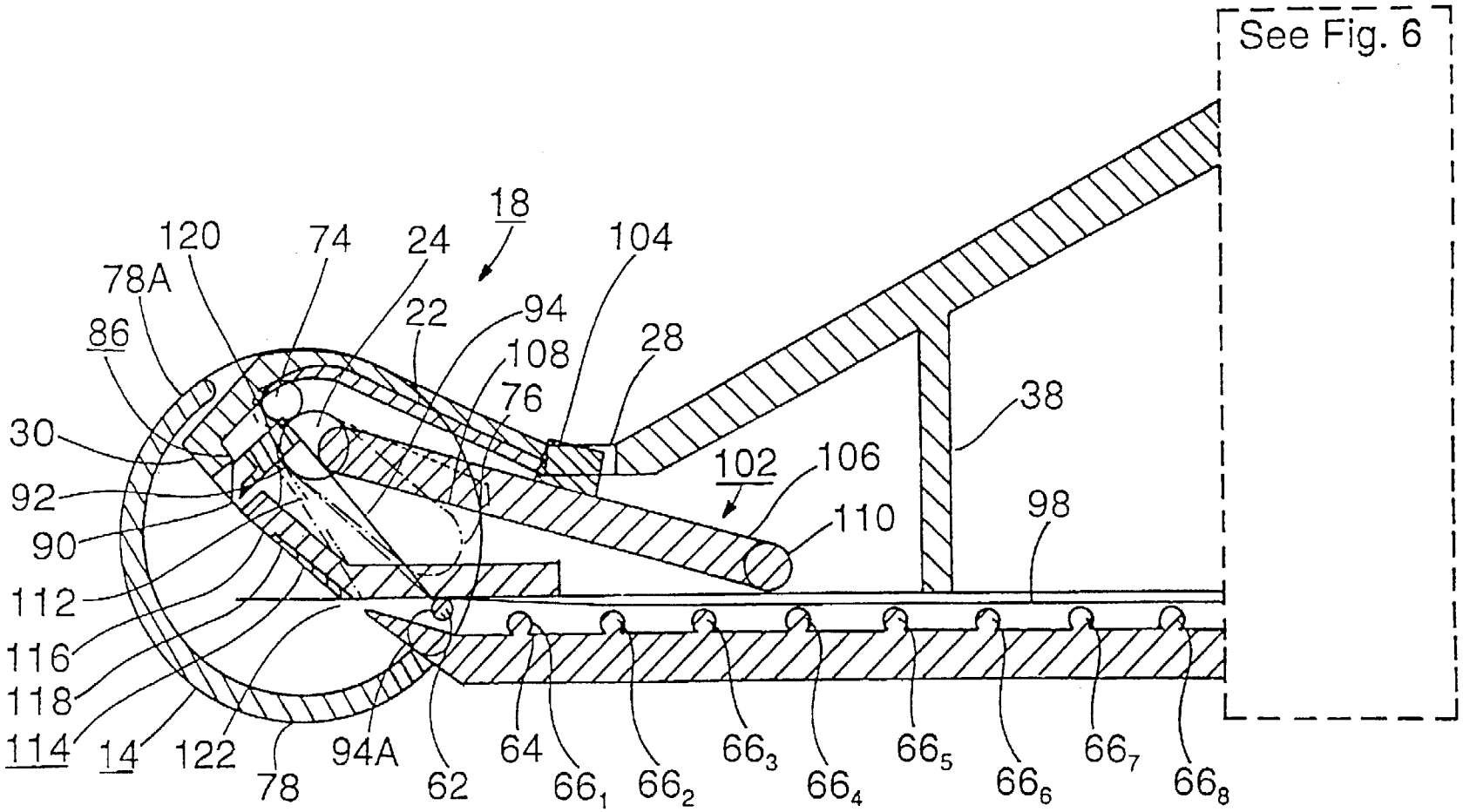
FIGS. 7, 8 and 9 illustrate further details of the applicator of FIGS. 1–6.

FIG. 7 illustrates an additional element of applicator 10 which is the actuator member 102. The actuator member 102 has a neck 104 that is dimensioned so as to be movable within the passageway 28. The actuator member 102 has first and second portions 106 and 108, laterally extending away from the neck 104 in opposite directions, with the first portion 106 having a device 110 (not shown but preferably having a structure similar to the prongs 94A and 96A), for mating with the actuator mating device 34 of the shell 12. The second portion 108 of the actuator member 102 is arranged to rest on the arm 94 of the cutting tool 86.

As seen in FIG. 7, the cutting tool 86 has a spring 112 inserted into its opening 92. The spring 112 supplies a force which tends to keep the cutting tool 86 in a vertical orientation and acts to return the cutting tool 86 to its orientation shown in FIG. 7 when the cutting tool 86 is disposed therefrom. It should be noticed that FIG. 7, as well as FIGS. 8 and 9, only partially illustrate the lower region of lever arm 94, especially near its prong 94A. This partial showing is accomplished so as to more clearly illustrate the opening where the leading edge of the tape 98 (to be described with reference to FIGS. 8 and 9) leaves or exits from the cartridge 44.

FIG. 7 further illustrates another element of applicator 10, that is, a contact member 114 having an upwardly raised portion 116. The raised portion 116 has first 118 and second 120 faces, with the first face 118 being arranged so as to be capable of coming into contact with the adhesive face of the leading edge of the tape being dispensed by the applicator 10. The first face 118 preferably comprises a resilient material. As will be further described hereinafter, the resilient material of the first face 118 allows the applicator 10 to be pressed down onto a surface of interest without .any scarring thereof which is of particular importance, especially when using the applicator 10 in the wrapping of presents contained within fragile packages. The raised portion 116 is positioned in the first passageway 26 so as to be proximate to the cutting tool 86. As to be further described, the cutting tool 86 and the contact member 114 cooperatively operate to cut the tape 98 which is arranged to be fed out of the applicator 10 at the opening 122. The width of the opening 122 exceeds that of the tape 98.

As seen in FIG. 7, the partial cylindrical member 78 provides a barrier or enclosure for such an opening 122. The partial cylindrical member 78 has one end that has its middle section tapered and dimensioned so as to form a contoured end 78A that is insertable into the second passageway 28. As further seen in FIG. 7, the contoured end 78A is positioned proximate the leading edge 30 of the shell 12. Still further, as seen in FIG. 7, when the partial cylindrical member 78 provides an enclosure for opening 122, the pin 24 of the shell 12 is located in the upper corner (as viewed in FIG. 7) of the groove 76 of cover 14 and, also, the pin 74 of the cover 14 is at the upper corner (as viewed in FIG. 7) of the groove 22 of the shell 12. When these pins 24 and 74 are at the respective locations shown in FIG. 7, the tape 98 is not exposed to any contaminants. This non-exposure keeps the tape free from contaminants and becomes readily available to be applied to a surface of interest. The tape may be applied by the manipulation of the cover 14 acting as a control knob and which may be further described with reference to FIG. 8.

Figure 8:
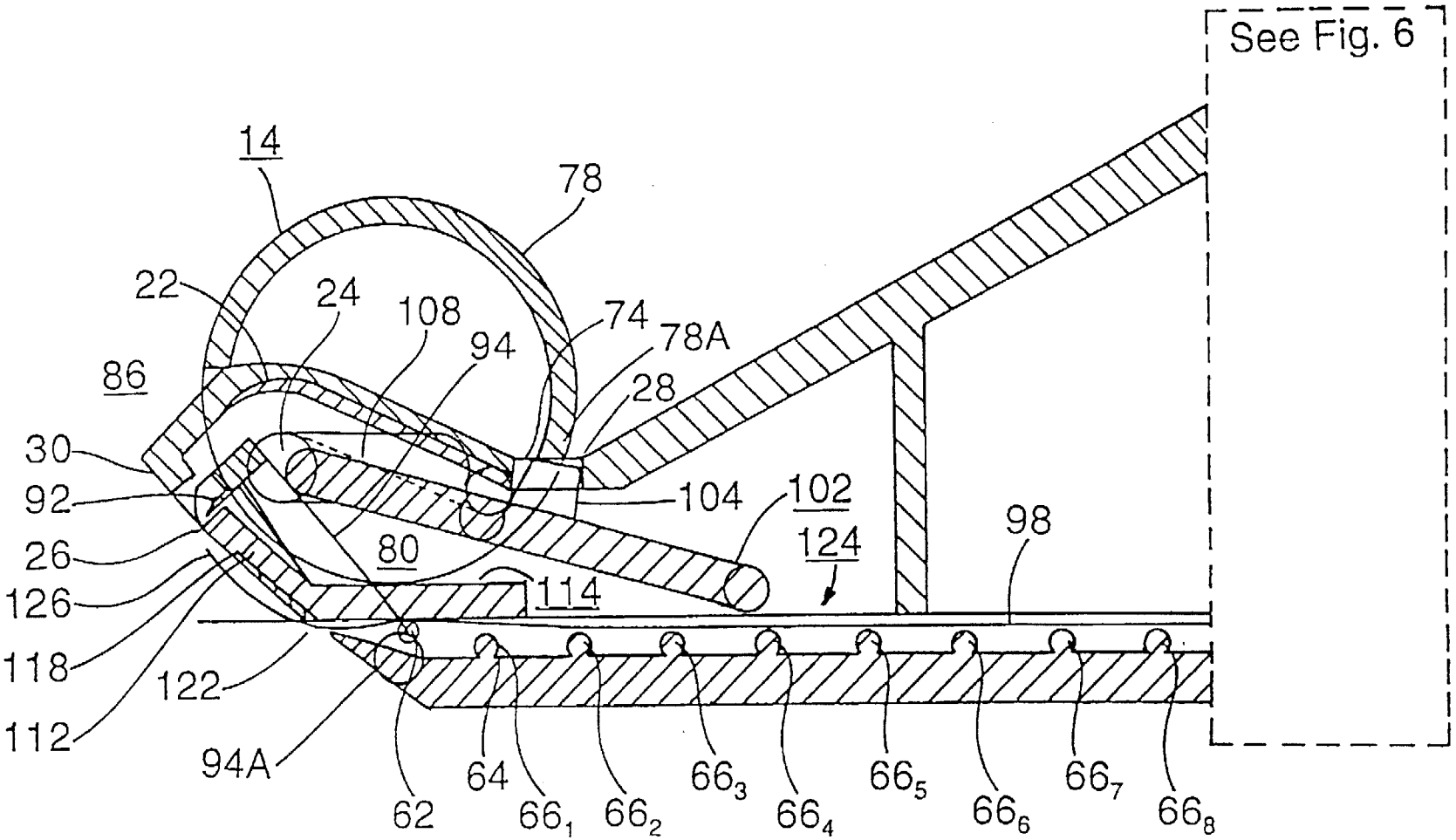

A comparison between FIGS. 8 and 7, reveals that the pin 24 is still located in the upper corner of the groove 76, but the upper corner of groove 76 has been rotated downward (as viewed in FIG. 8) by about 90 degrees, relative to its lower corner. Further, the pin 74 of FIG. 8 is now in the lower corner of the groove 22, shown in phantom, of the shell 12. In order to obtain such a reorientation of groove 76 and pin 74, the cover 14, in particular the partial cylindrical portion 78, need only be rotated in a counterclockwise direction and the curvature of the first and second grooves need only be selected so that the cover 14 is guided about the shell 12 to allow the contoured end 78A to be insertable into the second passageway 28. In this position, the cover 14 now may serve as a control knob that is used to move the cutting tool 86 in a manner so as to cut the tape 98. Such a movement may be further described with reference to FIG. 9.

Figure 9:
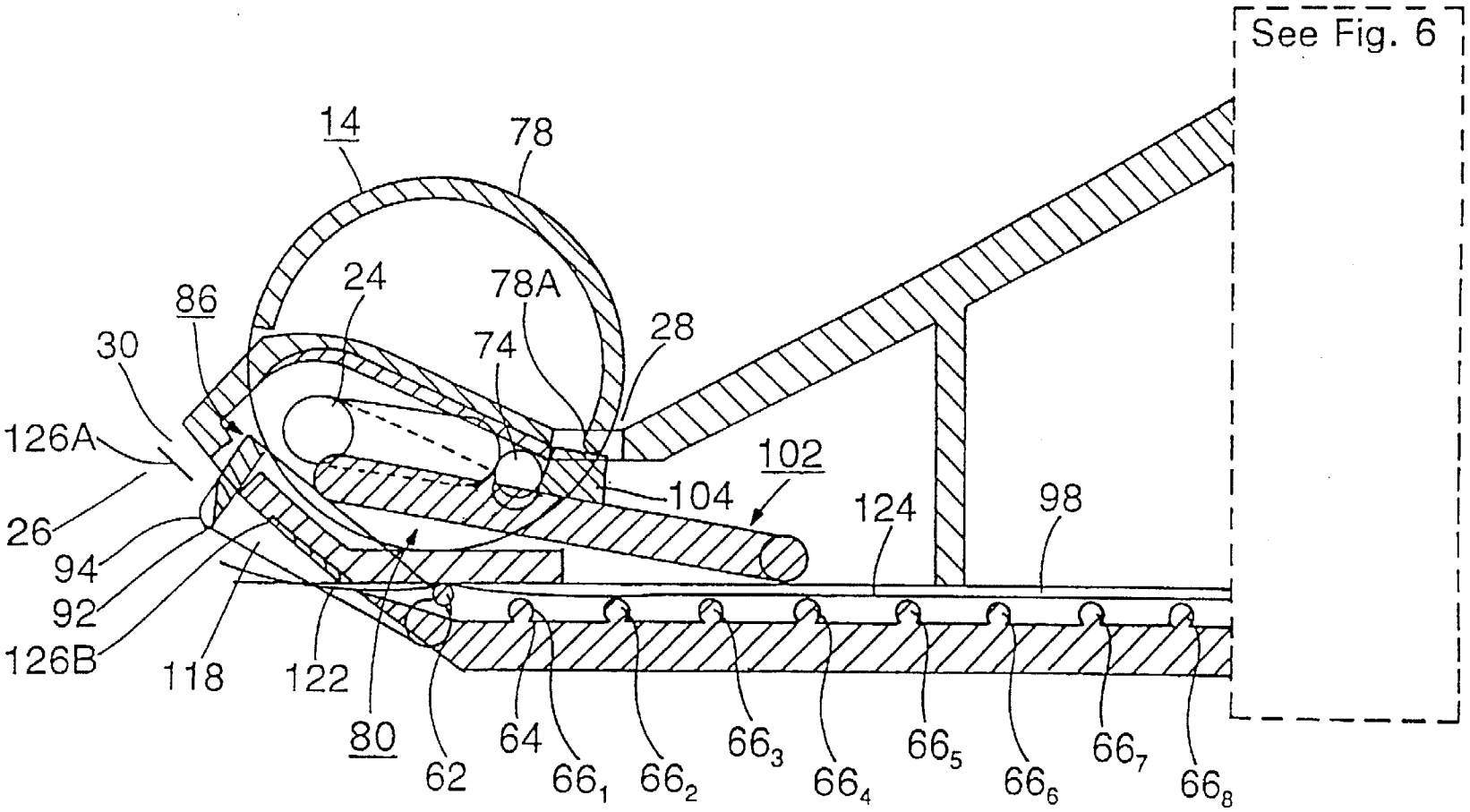

A comparison between FIGS. 9 and 8 reveals that the contoured end 78A of FIG. 9 is further inserted (relative to that shown in FIG. 8) into the passageway 28 which, in turn, causes the actuator 102 to have its second end 108 pressed down onto the lever arm 94 of the cutting tool 86 which, in turn, causes the cutting instrument 92 to exit from the first passageway 26 so that it may cut the tape 98 that is made available in the general region of the first face 118.

The operation of the applicator 10 may be described with a general reference to FIGS. 7, 8 and 9, and a more specific reference to FIGS. 10 and 11, which are perspective views showing the use of the applicator 10 applying and cutting the applied tape 98. As generally seen in FIG. 8, the non-adhesive face of the tape 98 is positioned above the anti-grip bars $66_1 \ldots 66_7$, and under the braking bar 62 so that its leading edge 126 is put into a position proximate the first face 118 of the contact member 114. As seen in FIG. 9, after the cutting tool has been moved by the counterclockwise rotation of cover 14 so as to exit the passageway 26, the cutting tool, in particular, the cutting instrument 92 intercepts and severs the tape 98 causing the leading edge 126 to be separated into two pieces 126A and 126B, with piece 126A remaining attached to the surface of interest (to be described) and piece 126B remaining releasably attached to the first face 118. The application of the tape 98 to a surface of interest and the cutting thereat, may be further described with reference to FIGS. 10 and 11.

Both FIGS. 10 and 11 illustrate the applicator 10 as being used on a surface of interest 128 to dispense adhesive tape 98 thereon. Further, FIGS. 10 and 11 illustrate that the applicator 10 is controlled by one hand 16 of an operator having one finger contacting the cover 14 which serves as a control knob.

As seen in FIG. 10, and again with reference to FIG. 8, the applicator 10 is held by one hand so as to establish a "mark." More particularly, with reference to FIG. 8, the applicator 10 is manipulated so that the first face 118 firmly comes into contact with the leading edge 126 and further manipulation of applicator 10, in a downward direction, causes the tape 98 to be pressed down and adhere to the surface of interest 128. Further, as seen in FIG. 10, the applicator 10 is held at an inclination 132. This inclination 132 is preferably established by resting the palm 16A of the one hand 16 onto the surface of interest 128. After establishing such an inclination, the user need only move the applicator 10 from left to right, as shown by arrow 134, until she/he has dispensed the desired amount of tape 98 and has reached a location 136, shown in FIG. 11. The initial movement of the applicator 10 on the surface of interest 128 causes the non-skid protrusion $82_N$ (see FIG. 4(A)) to catch on the surface 128 and to automatically initiate the counterclockwise rotation of the cover A comparison between FIGS. 11 and 10 reveals that the applicator 10 of FIG. 11 has been rotated in a counterclockwise direction, by about 120 degrees. Such rotation is allowed because the leading edge 30 (see FIG. 8) of the applicator 10 establishes a fixed position so as to allow rotation thereabout. Simultaneously during such rotation, the finger of the user rotates the cover 14 in a counterclockwise direction and which continued rotation, as described with reference to FIG. 9, causes the cutting instrument 92 to sever the tape 98. During such rotation and severing, it is preferred that the applicator 10 be held in such a manner so that tension exists in the tape 98. The tension contributes to the severing of the tape 98 by the cutting instrument 92.

As may be seen with reference to FIG. 9, after the leading edge of the tape 98 has been severed, any recoiling of the tape is prevented by the braking bar 62 which intercepts any backward movement of the tape 98 toward the roll 100.

It should now be appreciated that the practice of the present invention provides for an applicator that is easily manipulated by the single hand of a user so as to dispense adhesive tape onto a surface of interest and to only expose the tape to any environment that might contain contaminants during the dispensing thereof.

The applicator of the present invention can be disposed of once the originally installed tape 98 is exhausted or, conversely, the tape 98 on a roll 100 can be conveniently reinstalled into the reservoir 44. More particularly, as previously discussed, the reservoir 44 may be easily and quickly removed from the shell 12 by means of the snap-tight fittings provided by their respective prongs.

FIGS. 12–20 illustrate a second embodiment of an applicator 200 in accordance with the present invention. The applicator 200 in the second embodiment performs the same function as the applicator 10 of the first embodiment, but differs in the construction of the shell and cartridge. The second embodiment also differs in the method of moving the cover member and cutting tool.

Figure 12:
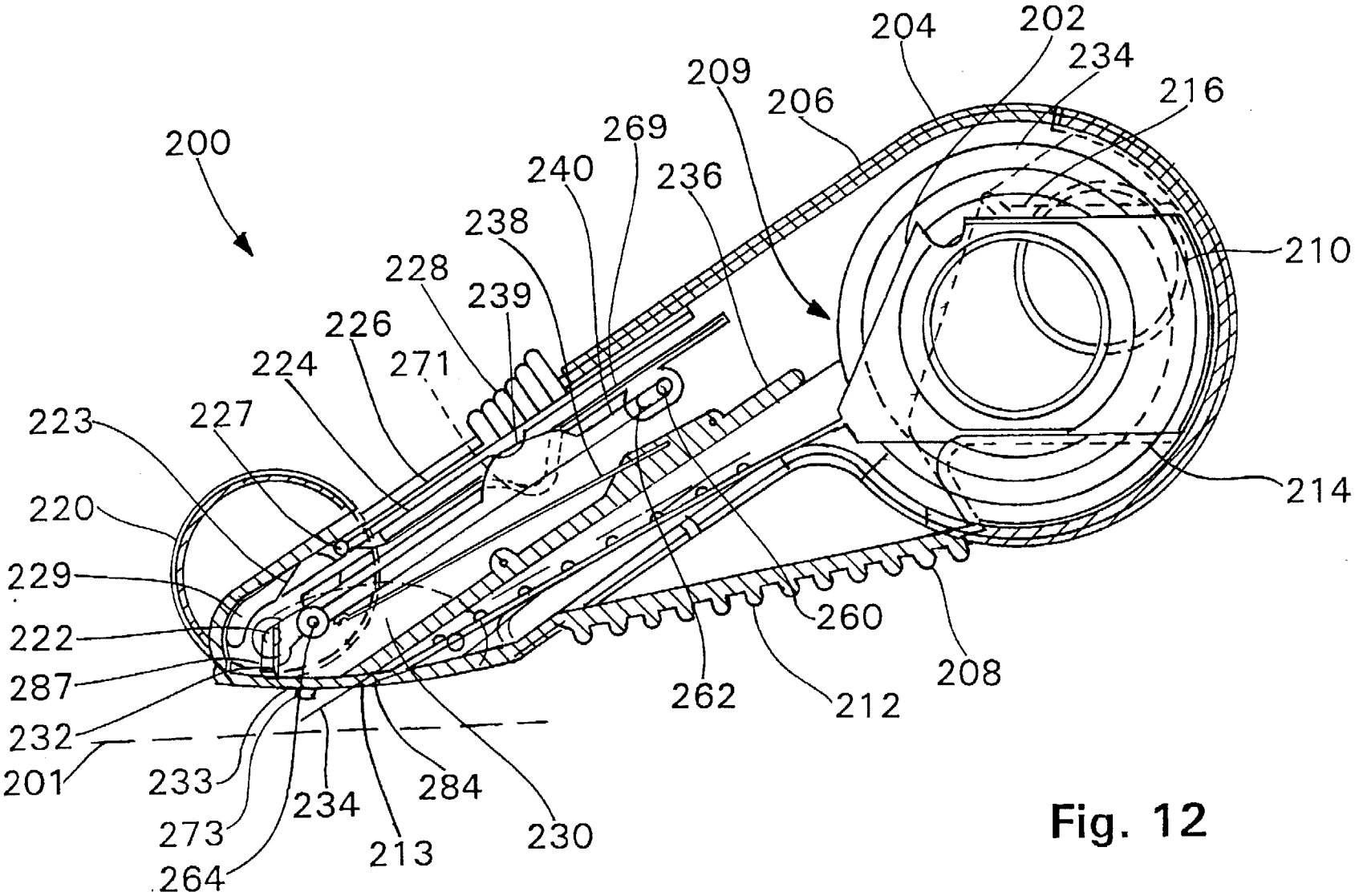
FIG. 12 is a cross-sectional view of an applicator in accordance with a second embodiment of the present invention.
Figure 13:
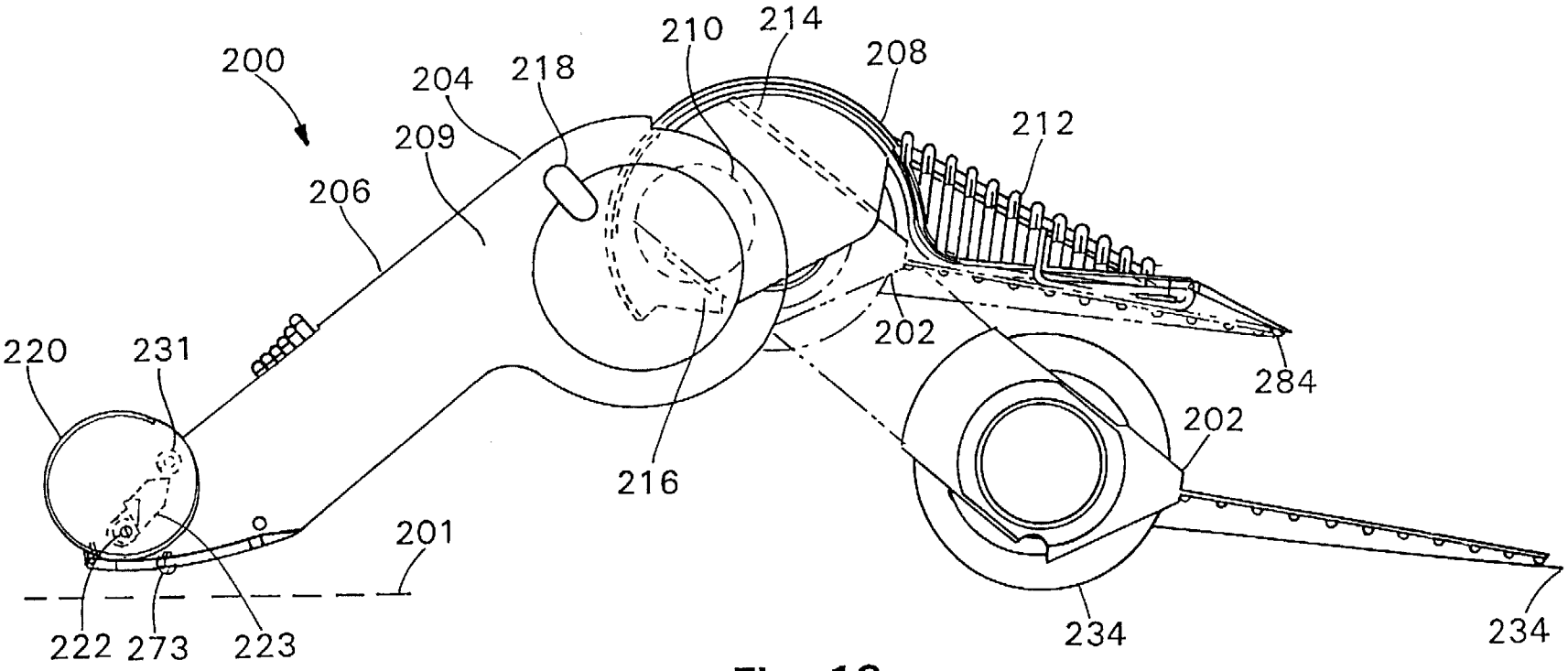
FIG. 13 is a side elevation view of the applicator of FIG. 12 in an open position ready to receive a cartridge, and a cartridge exploded from the applicator.

FIG. 12 is a cross-sectional view of the applicator 200 in accordance with a second embodiment of the present invention. FIG. 13 is a side elevation view of the applicator 200 of FIG. 12 as it appears when installing, removing or changing a cartridge 202. FIG. 13 also shows the cartridge 202 exploded from the applicator 200 prior to being inserted into the final insertion position (shown in phantom). The applicators 200 shown in FIGS. 12 and 13 are identical. However, the applicator 200 in FIG. 12 additionally shows the internal structure of a tape cutter mechanism associated therewith. The applicator 200 in FIGS. 12 and 13 is shown in an orientation for applying tape 234 to a horizontal surface 201. For clarity, FIGS. 12 and 13 are described together.

The applicator 200 includes a shell 204 having an upper portion 206 and a door 208. The upper portion 206 has a hollow region 209 for receiving the cartridge 202. The door 208 pivotally attaches to the upper portion 206 at hinge 210. The hinge 210 is defined by an integrally molded circular impression in the upper portion 206 and an integrally molded annular opening in the door 208. The door 208 opens and closes from the upper portion 206 in a clamshell manner and snaps shut onto the upper portion 206. The door 208 has a ribbed gripping region 212 for facilitating opening and closing of the door 208 and for facilitating use of the applicator 200. The forward end 213 of the applicator 200 presents a smooth surface to the surface 201. The tape exits the applicator 200 at the forward end 213, and at the joint between the door 208 and the upper portion 206.

The inner surface of the door 208 includes two parallel rails 214, 216 which act as a slot for removably receiving the cartridge 202. The parallel rails 214, 216 may also be integrally molded with the door 208.

The upper portion 206 includes a window 218 (shown in FIG. 13) for viewing the amount of tape 234 left on the cartridge 202. The upper portion 206 also includes a cover member 220 and a cover pivoting pin 222, located on the sides of the shell 204, which is engaged in recesses 223 in the sides of the cover 220. The cover member 220 pivots in the same general manner as shown in the first embodiment to cover and expose the end of the tape 234 and allow for operation of a cutter (described below). However, in the second embodiment of the invention, the cover member 220 is moved from the covered position to the exposed position by a slider mechanism 224. The slider mechanism 224 includes a slider 226 which reciprocates between a first position (shown in FIGS. 12 and 14C) and a second position (shown in FIG. 14B). The slider 226 is supported on slider support members 269 attached to the shell 204 and is moved by a button 228 rigidly attached to the slider 226. A cutter actuator 239 is located on the slider 226, in a position opposite to the button 228. Complementing recesses 271 to the cutter actuator 239 are located in the slider supports 269. The button 228 extends outward from the upper portion 206 of the shell 204. Two pins 227 are attached to the slider 226 and protrude through slots 229 in the sides of the upper portion 206 to engage complementary recesses 231 (shown in FIG. 13) in the cover 220.

The upper portion 206 also includes a cutter 230, pivotally attached to the shell 204, having a blade 232. A cutter mechanism allows the cutter 230 to extend from, and retract into, the shell 204 from an open region 233 in the shell 204. Preferably, the blade 232 is mounted between two cutter guards 287. In the extended position, the cutter 230 extends outward from the upper portion 206 and is thus positioned to cut the tape 234 at or near the end. The blade 232 is spaced inward from the edges of the guards 287 of the cutting mechanism to prevent the blade 232 from contacting and damaging the surface 201 to which the tape is being applied during cutting. In the retracted position, the cutter 230 cannot touch the surface 201 or interfere with the tape applying process.

The cutter mechanism includes a spring board 236, spring 238 and activator 240. The rear end of the activator 240 is attached to the upper portion 206 by a pin 260 which is slidably mounted in a slot 262 formed in the upper portion 206. The forward end of the activator 240 is attached to the cutter 230 by another pin 264. The button 228 mechanically cooperates with the cutter mechanism to extend and retract the cutter blade 232. That is, inward pressure can be applied to the button 228 to cause the cutter blade 232 to extend outward from the upper portion 206. A more detailed discussion of the operation of the cutter mechanism is provided below with respect to FIG. 14C. The button 228 must be in the second position to provide the necessary pressure and operate the cutter mechanism. The button 228 cannot be pushed down in the first position. Thus, the button 228 performs the dual function of exposing the tape end for use in taping by moving the cover 220 from over the open region 233, and for operating the cutter 230.

Preferably, a burnisher 273, in the form of a C-shaped section is attached to the shell 204 at the open region 233, adjacent to and spaced from the path of the cutter 232. The burnisher 273 extends across the width of the shell 204 to firmly press the tape down as it is being applied. In the presently preferred embodiment, the burnisher 273 is made of a resilient material of a low to medium durometer, in order to press the tape in position. The burnisher 273 also covers the manufacturing seams between the shell halves 204 to ensure that a smooth surface presses the tape into position.

Figure 14A:
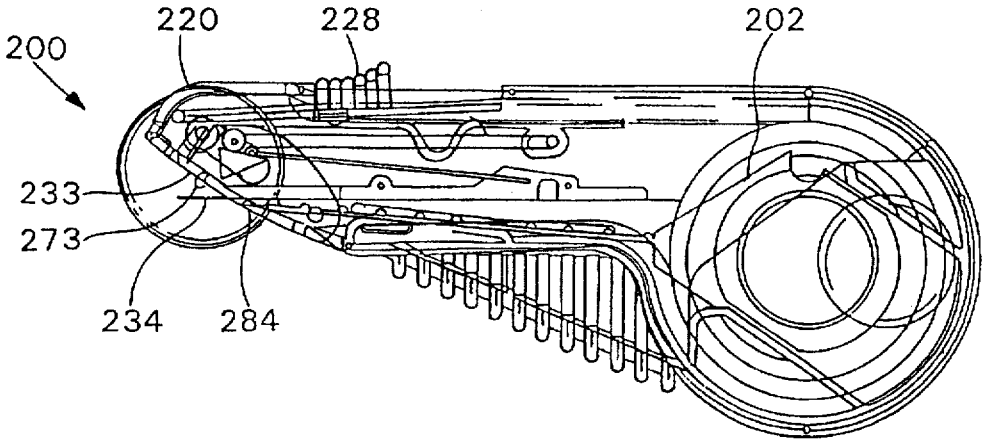
FIGS. 14A–14C are side elevation views of the applicator in accordance with the second embodiment of the present invention, showing the applicator in its closed, open and cutting positions, respectively.
Figure 14B:
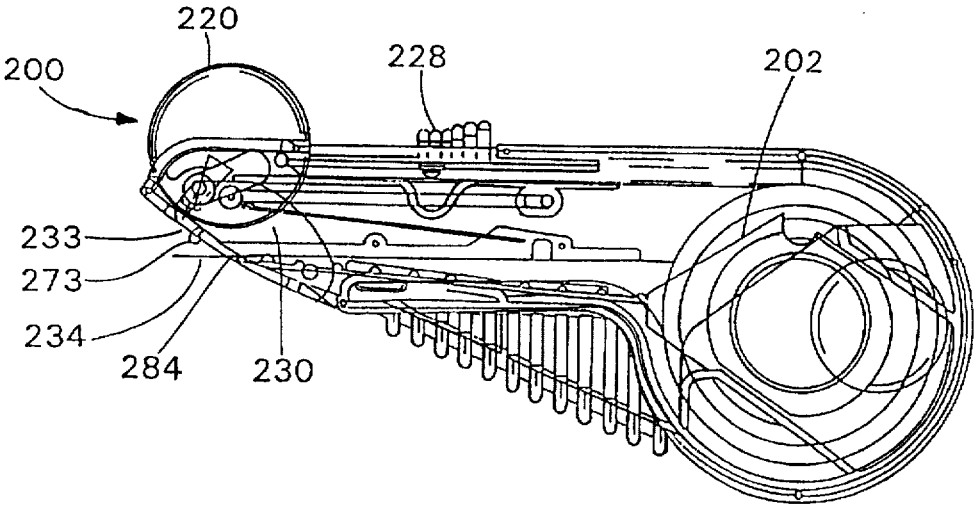
Figure 14C:
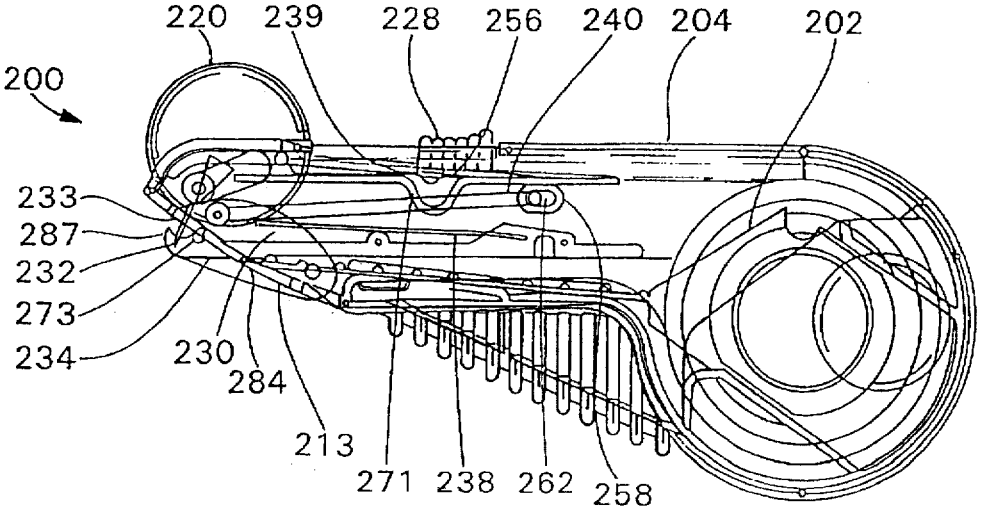

FIGS. 14A–C show the applicator 200 in the closed, open and cutting positions, respectively. FIG. 14A shows the applicator 200 in its closed position. The button 228 is in the first position and the cover member 220 covers the end of the tape 234 and the open region 233. FIG. 14B shows the applicator 200 in its open position. The button 228 is in the second position and the cover member 220 is pivoted upward to expose the end of the tape 234 and the open region 233. The cutter 230 is fully retracted into the shell 204. FIG. 14C shows the applicator 200 in its cutting position, with the cutter actuator 239 in general alignment with complementary recesses 271 in the slider supports 269. The button 228 is again in the second position but is pushed in such that the cutter actuator 239 contacts the activator to mechanically activate the cutting mechanism and cause the cutter 230 to partially extend from the shell 204. In this position, the cutting blade 232 of the cutter 230 can cut the end of the tape 234 by slightly pivoting the applicator 200 about the forward end 213.

Referring to FIG. 14C, as the button 228 is pushed down, it pivots in a slot 256 in the upper portion 206 and presses against fulcrum 258 of the activator 240. In turn, the activator 240 pivots downward and pushes down against the cutter 230 to rotate the cutter 230 out and into the path of the tape, thereby cutting the tape. As the activator 240 pivots downward, it moves forward in the slot 262.

FIGS. 15A, 15B, 16A, 16B, 17A, 17B, 18A and 18B show in more detail the tape cartridge 202 employed with the second embodiment of the invention. FIGS. 15A, 16A, 17A and 18A show, respectively, a perspective view, end view, top plan view and side elevation view of the tape cartridge 202 before a roll of tape is mounted therein. FIGS. 15B, 16B, 17B and 18B show, respectively, a perspective view, end view, top plan view and side elevation view of the tape cartridge 202 after a roll of tape 242 is mounted therein. For clarity, these figures are described together.

The tape cartridge 202 includes a tape holder 243 defined by cylindrical roll 244 for receiving the roll of tape 242, a stepped axle 245 at opposite sides of the roll 244, and a pair of sidewalls 246 and 248, each sidewall disposed at opposite sides of respective stepped axles 245. The sidewalls 246 and 248 are shaped and sized so as to mate with the parallel rails 214, 216 of the shell's door 208, as most clearly shown in FIG. 13.

In the presently preferred embodiment, the side walls 246, 248 are approximately the same size. However, it will be understood by those skilled in the art that the size of one side wall 246 can be changed, and the spacing of the rails 214, 216 adjusted accordingly such that the tape cartridge 202 cannot be inserted improperly. It will be similarly recognized that other types of keying features, such as mating slots and protrusions, can be provided, if desired.

Figure 16A:
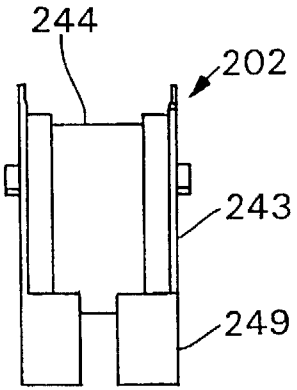
FIG. 16A shows an end view of the tape cartridge employed with the second embodiment of the invention before a roll of tape is mounted in the cartridge.
Figure 16B:
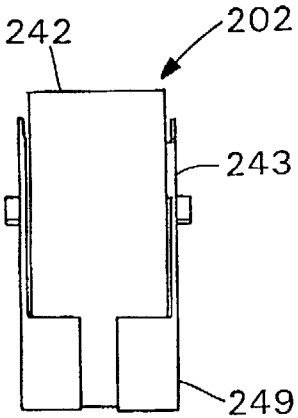
FIG. 16B shows an end view of the tape cartridge employed with the second embodiment of the invention after a roll of tape is mounted in the cartridge.
Figure 15A:
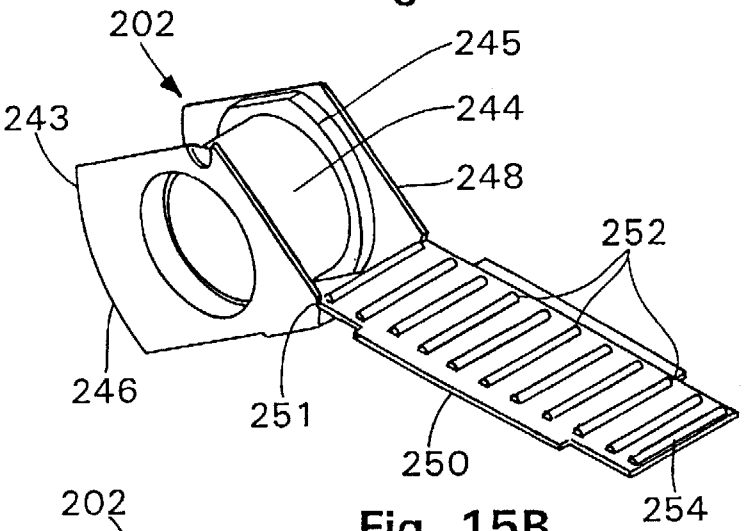
FIG. 15A shows a perspective view of the tape cartridge employed with the second embodiment of the invention before a roll of tape is mounted in the cartridge.
Figure 15B:
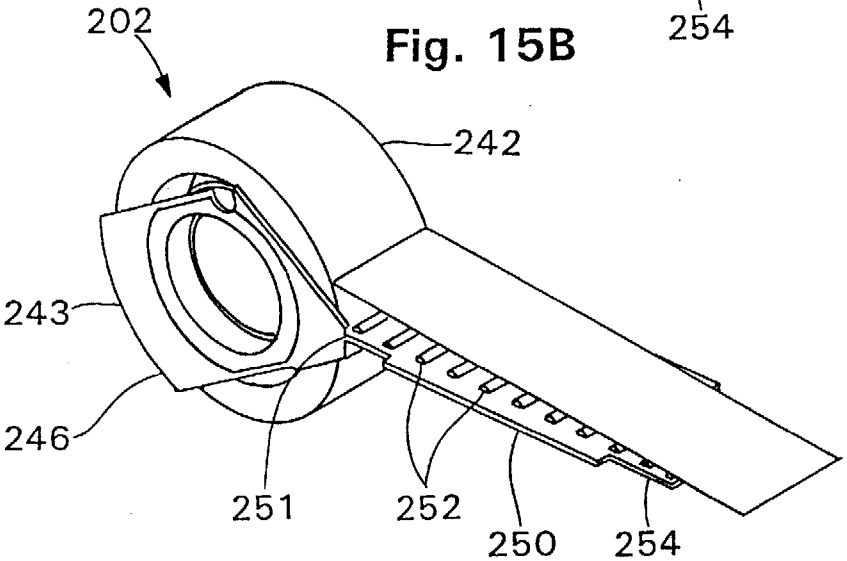
FIG. 15B shows a perspective view of the tape cartridge employed with the second embodiment of the invention after a roll of tape is mounted in the cartridge.
Figure 17A:
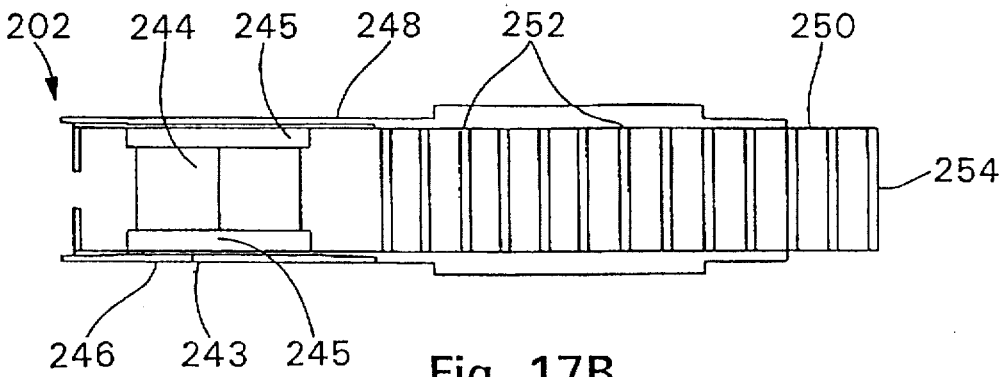
FIG. 17A shows a top plan view of the tape cartridge employed with the second embodiment of the invention before a roll of tape is mounted in the cartridge.
Figure 17B:
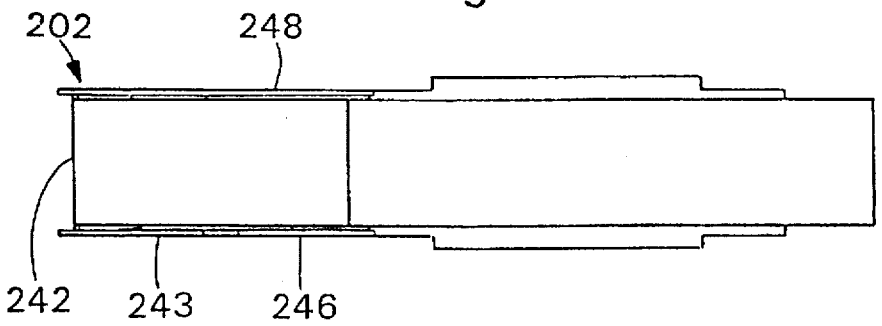
FIG. 17B shows a top plan view of the tape cartridge employed with the second embodiment of the invention after a roll of tape is mounted in the cartridge.
Figure 18A:
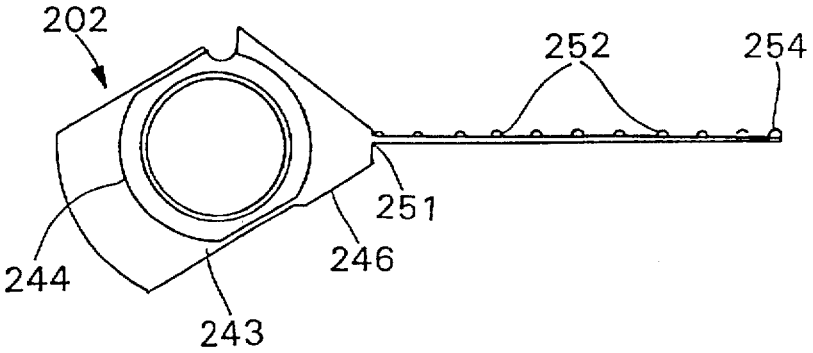
FIG. 18A shows a side elevation view of the tape cartridge employed with the second embodiment of the invention before a roll of tape is mounted in the cartridge.
Figure 18B:
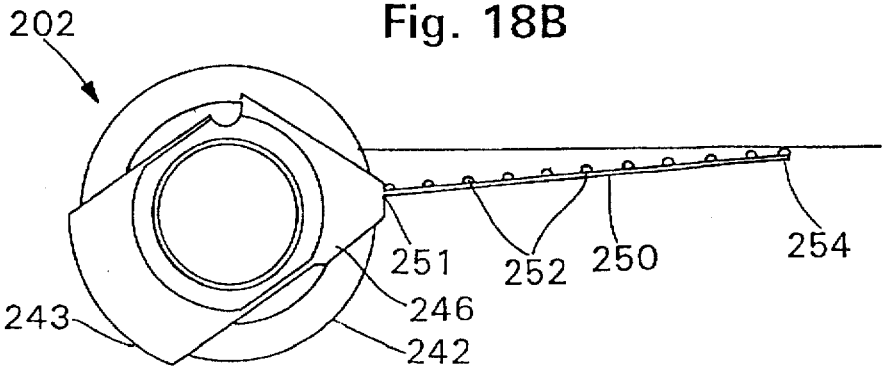
FIG. 18B shows a side elevation view of the tape cartridge employed with the second embodiment of the invention after a roll of tape is mounted in the cartridge.

As best shown in FIGS. 16A and 16B, the tape holder 243 also includes a keeper 249. The function of the keeper 249 is described below with respect to FIG. 20.

The tape cartridge 202 also includes a tongue 250 which extends from the tape holder 243. The tongue 250 is attached to the tape holder 243 by a living hinge 251. The tape passes over the tongue 250 as it is dispensed from the roll 244. The tongue 250 has mounted thereon a plurality of bumps or bar members 252 that laterally extend across the width of the tongue 250, and an outermost brake or bar member 254 located at the end of the tongue 250. The outermost bar member 254 is raised above the other bar members 252. The bar members 252 and 254 may have any shape but preferably have a cylindrical rod configuration. The tongue 250 and bar members 252 and 254 perform similar functions as the rail 58 and bar members 66 of the first embodiment of the invention.

Referring again to FIG. 13, a bar 284 may also be provided on the end of the door 208. The bar 284 on the end of the door performs a similar function to the bar member 254 on the tape cartridge 202 of preventing the cut end of the tape from recoiling back into the applicator 200. The bar 284 allows tape to be properly dispensed if a roll is installed in the applicator 200 without a cartridge 202, if a cartridge is unavailable. However, those skilled in the art will recognize that the tape will then have to be threaded by hand through the applicator 200.

FIG. 19 shows one method of assembling a tape cartridge 202 with a roll of tape 242 mounted thereon before the cartridge 202 is loaded into the applicator 200. The roll of tape 242 is inserted over the roll 244 and the sidewall 246 is snapped into the roll 244. Preferably, the sidewall 246 is not removable after the initial assembly. Thus, when the roll of tape 242 is exhausted, the entire cartridge 202 would then be discarded and a new fully assembled cartridge 202 would be loaded into the applicator 200. Alternatively, the sidewall 246 could be removable so that the cartridge 202 could be reused.

In the preferred embodiment of the invention, the tape is prerolled onto the tongue 250. Thus, when a new cartridge 202 is inserted into the applicator 200, the end of the tape is already at the outermost bar member 254 and the tape may be immediately applied to a surface. In this manner, the user need not touch the end of the tape, or any other portion of the tape when loading and starting a new cartridge 202.

In the preferred embodiment of the invention, the tongue 250 is constructed of a flexible plastic material and is capable of being bent around the roll of tape 242 while the tape is attached to the tongue 250, as shown in FIG. 20. In this manner, a fully assembled cartridge 202 may be packaged in a smaller box than would be required to package a cartridge 202 with a fully extended tongue 250. The tongue 250 is tucked into the keeper 249. Before the cartridge 202 is loaded into the applicator 200, the tongue 250 is slipped out of the keeper 249. The tongue 250 then springs into the fully extended position shown in FIG. 15B. The cartridge 202 is then ready for insertion into the applicator 200.

Figure 22:
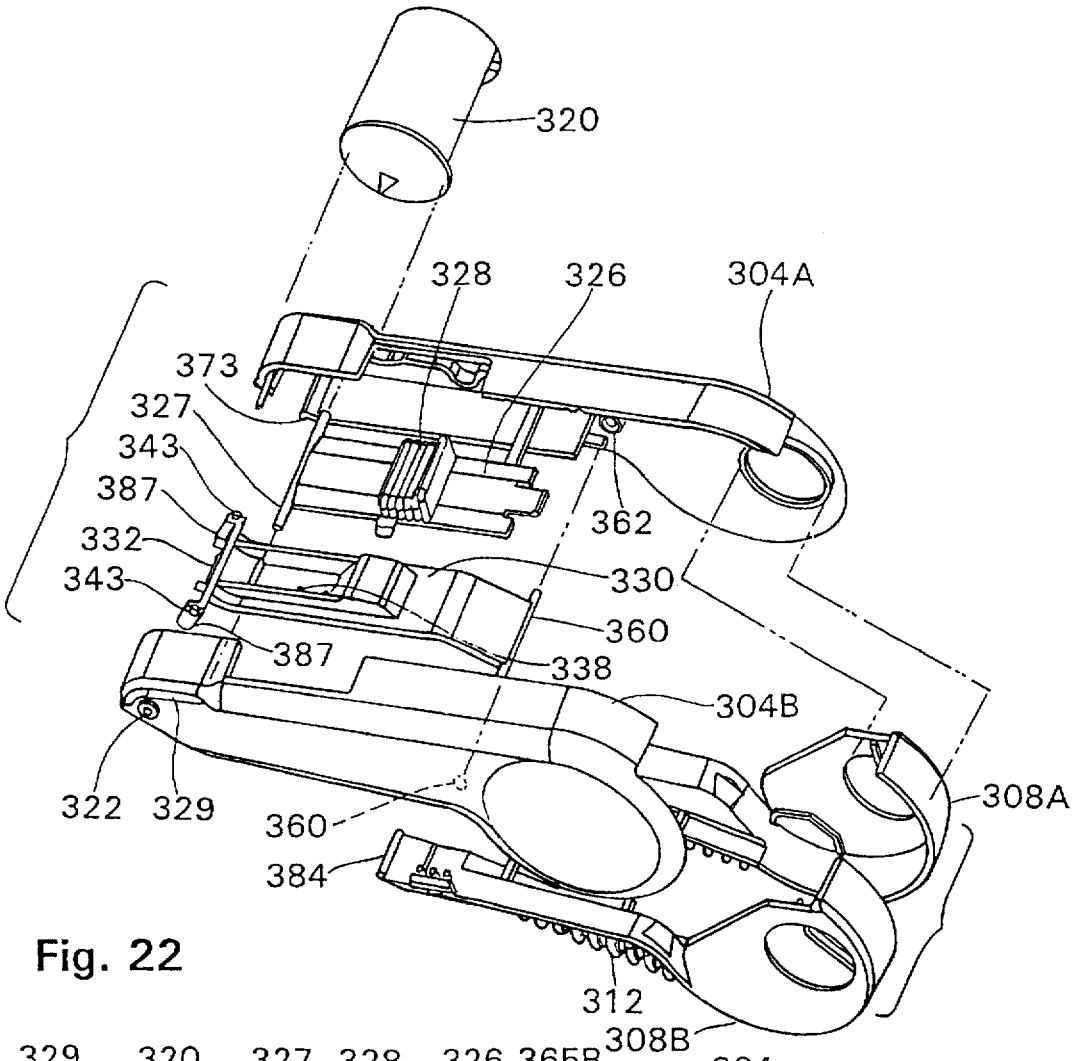
FIG. 22 is a disassembled perspective view of the third embodiment of the invention.
Figure 21:
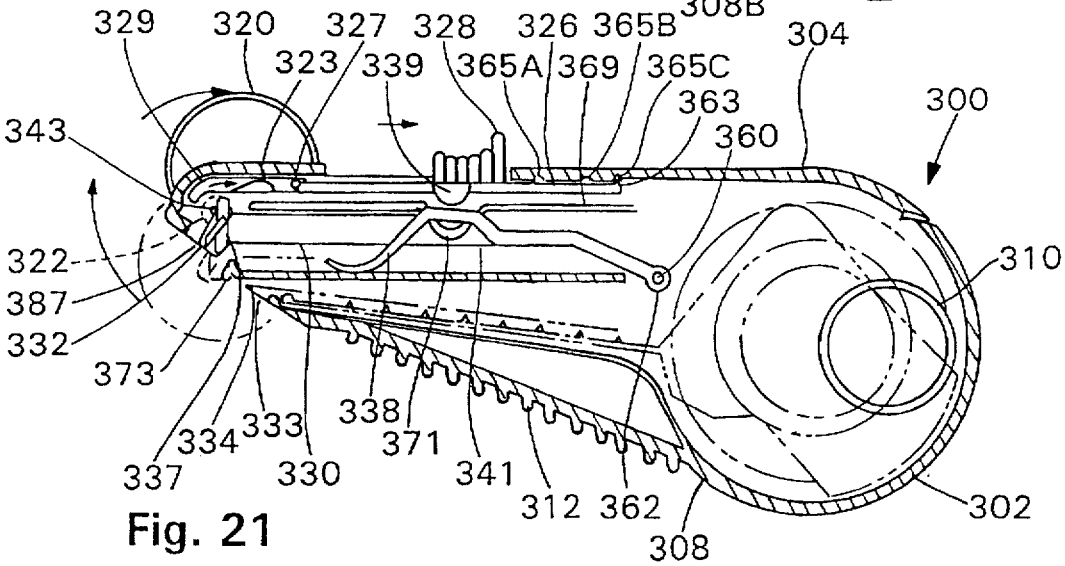
FIG. 21 shows a cross-sectional view similar to FIG. 12 of a third embodiment of the invention.

Referring now to FIGS. 21 and 22, a third embodiment 300 of a tape applicator is shown. The third embodiment of the applicator 300 is similar to the second embodiment 200, and like elements have been designated with similar reference numerals having the with the hundreds digit being "3" instead of "2". For example, the shell 304 of the third embodiment of the tape applicator 300 is similar to the shell 204 of the second embodiment of the applicator 200, except for the differences noted in detail below.

Referring to FIG. 21, the third embodiment of the applicator 300 includes a shell 304, which is preferably made from two halves 304A and 304B, as shown in FIG. 22. A door 308 is attached to the shell by a hinge 310. Preferably, the door 308 is also made of two halves 308A and 308B, as shown in FIG. 13. The shell 304 and door 308 can be pivoted between an open, cartridge loading position, and a closed position, as previously discussed in connection with the second embodiment. For clarity, the cartridge 302 has been shown in phantom lines in FIG. 21.

Preferably, a burnisher 373 is provided on the shell 304 adjacent to the open region 333, and is molded as an integral part of the shell. The burnisher 373 burnishes the tape 334 as it is applied, pressing the tape into position. Those skilled in the art will recognize from the present disclosure that burnisher 373 may be provided as a separate part similar to the second embodiment 200, or that a separate resiliant clip (not shown) can be placed over the burnisher 373 to cover the manufacturing seal between the two halves of the shell, if desired.

The cover 320 is operated in the same manner as the cover 220 described in conjunction with the second embodiment 200, with the button 328 being used to slide the slider 326 along slider supports 333 to rotate the cover 320 between the closed position (shown in phantom lines) and two open positions. In the third embodiment 300, the slider 326 includes a raised bead 363 at the second end. Three detent notches 365A, B. C are defined on the inside of the shell 304 in complementing positions to the bead 363. The bead 363 is located in the first detent notch 365A when the slider 326 is in the first position, with the cover 320 being closed. The button 326 is then used to move the slider 326 to a second, tape applying position with the bead 363 on the slider 326 being located in the second detent notch 365B. In the second position, the button 328 cannot be depressed inwardly to actuate the cutter mechanism because the cutter actuator 339 is not aligned with the complementary recesses 371 in the slider supports 369. In the third position, as shown in FIG. 21, the bead 236 is located in the third detent notch 365C, with the cutter actuator 371 being in general alignment with the recesses 371 the slider supports 369 to allow the button 328 to be depressed to cut the tape. The second position provides a safety position to prevent premature cutting of the tape 3.

The button 328 is also used to actuate the cutter mechanism 341. The cutter mechanism 341 includes a support arm 330, which supports the blade 332 at a first end. Two guide pins 343 are located on the first end of the support arm 330, and are slidable in complementary aligned grooves 337 on each side of the shell 304. Cutter guards 387 are located adjacent to the blade 332, and the blade 332 is spaced inwardly from the edges of the side portions 387 to prevent the blade 332 from damaging the surface to which the tape is being applied. A pivot pin 360 is located at the second end of the support arm 330, and is pivotally mounted in a pair of aligned bores 362 in the shell 304. An integral spring 338 is formed as part of the support arm 330, and biases the support arm 330 to a first position, wherein the blade 332 is fully retracted in the shell 304. When the slider 326 is in the third position, as shown in FIG. 21, with the cutter actuator 339 aligned with the recesses 371 in the slider supports 369, inward pressure can be applied to the button 328 to depress the button 328. The cutter actuator 339 contacts the support arm 330 as the button 328 is depresses to pivot the support arm 330 about the pin 360 at the second end such that the blade 332 on the first end extends from the shell 304 to the cutting position (shown in phantom lines in FIG. 21).

Figure 23:
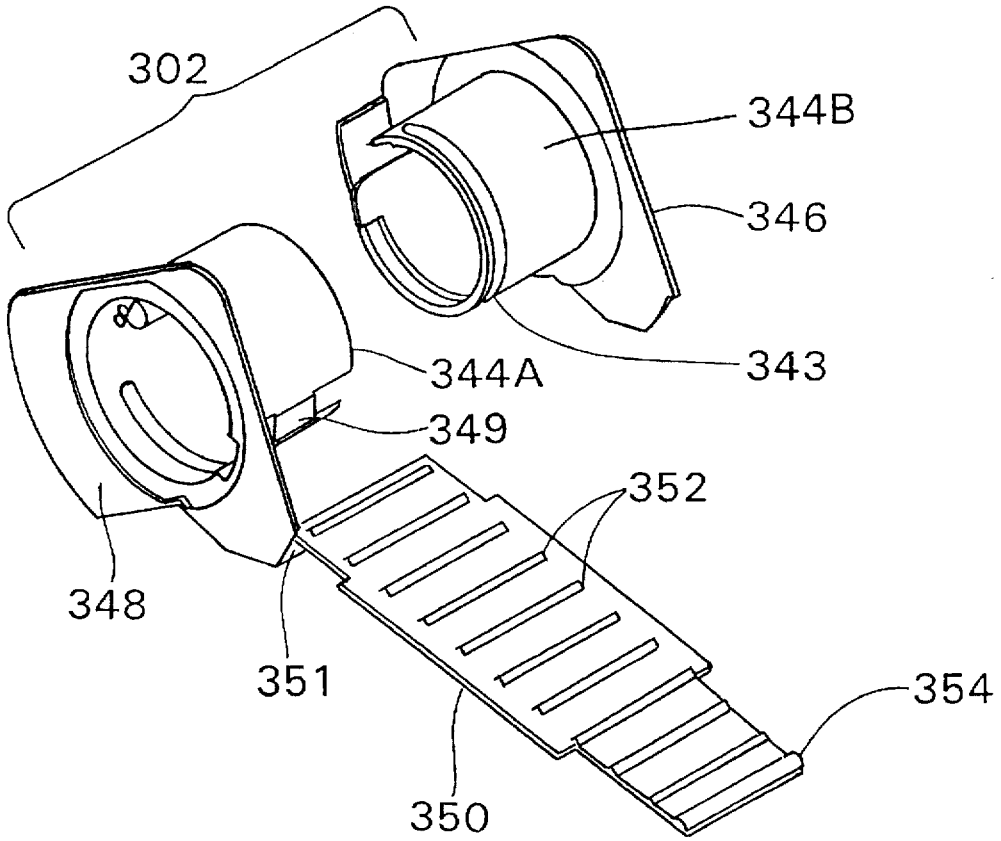
FIG. 23 is a perspective view of a partially disassembled tape cartridge in accordance with the present invention.
Figure 24:
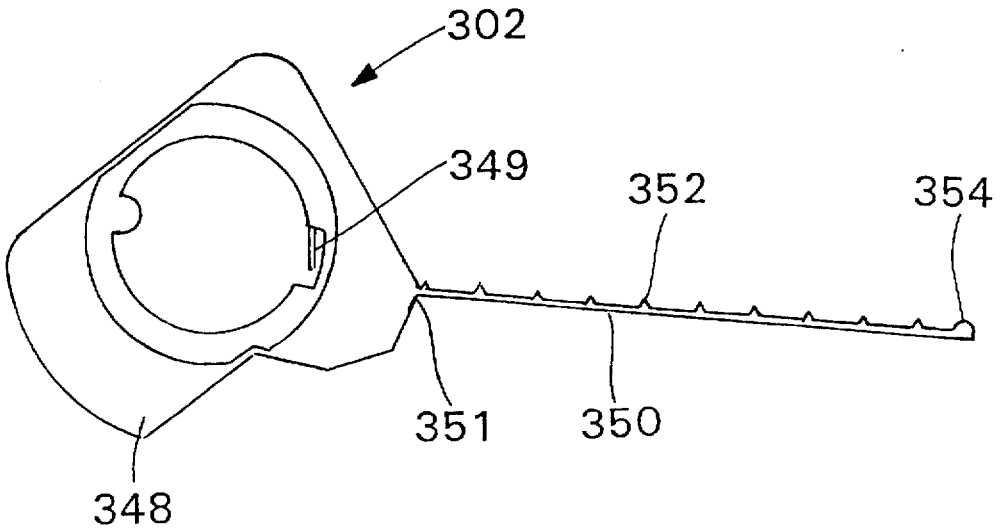
FIG. 24 is a side elevational view of the tape cartridge in accordance with the third embodiment of the invention.

Referring to FIGS. 23 and 24, the tape cartridge 302 is similar to the tape cartridge described in connection with the second embodiment of the applicator 200, and is installed and removed in the same manner. Roll portions 344A and 344B are connected together to hold a roll of tape in position. A brake 349 is located on one roll portion 344A. Preferably, the brake 349 is formed integrally with the roll 344A on one side wall 348, and is in the form of a resilient leaf spring which contacts the inside of the tape spool (not shown) to prevent it from unwinding if tape is not being applied.

While the tape cartridge 302 can be designed to accommodate varying widths of tape, in the third embodiment, the tape cartridge is designed to accommodate a tape width of ¾ inch. However, if narrower width tape is to be used in conjunction with the cartridge 302, spacer rings are provided which can be installed on the roll portions 344A and 344B to keep the narrow tape roll in a centered position. For example, if tape having a width of ½ inch is provided, two spacer rings having a thickness of approximately ⅛ inch are used to center the roll in the applicator 300.

The third embodiment of the tape applicator 300 is used in a similar manner to the second embodiment 200, and provides the advantage of having fewer parts, which reduces cost and assembly time.

Figure 25:
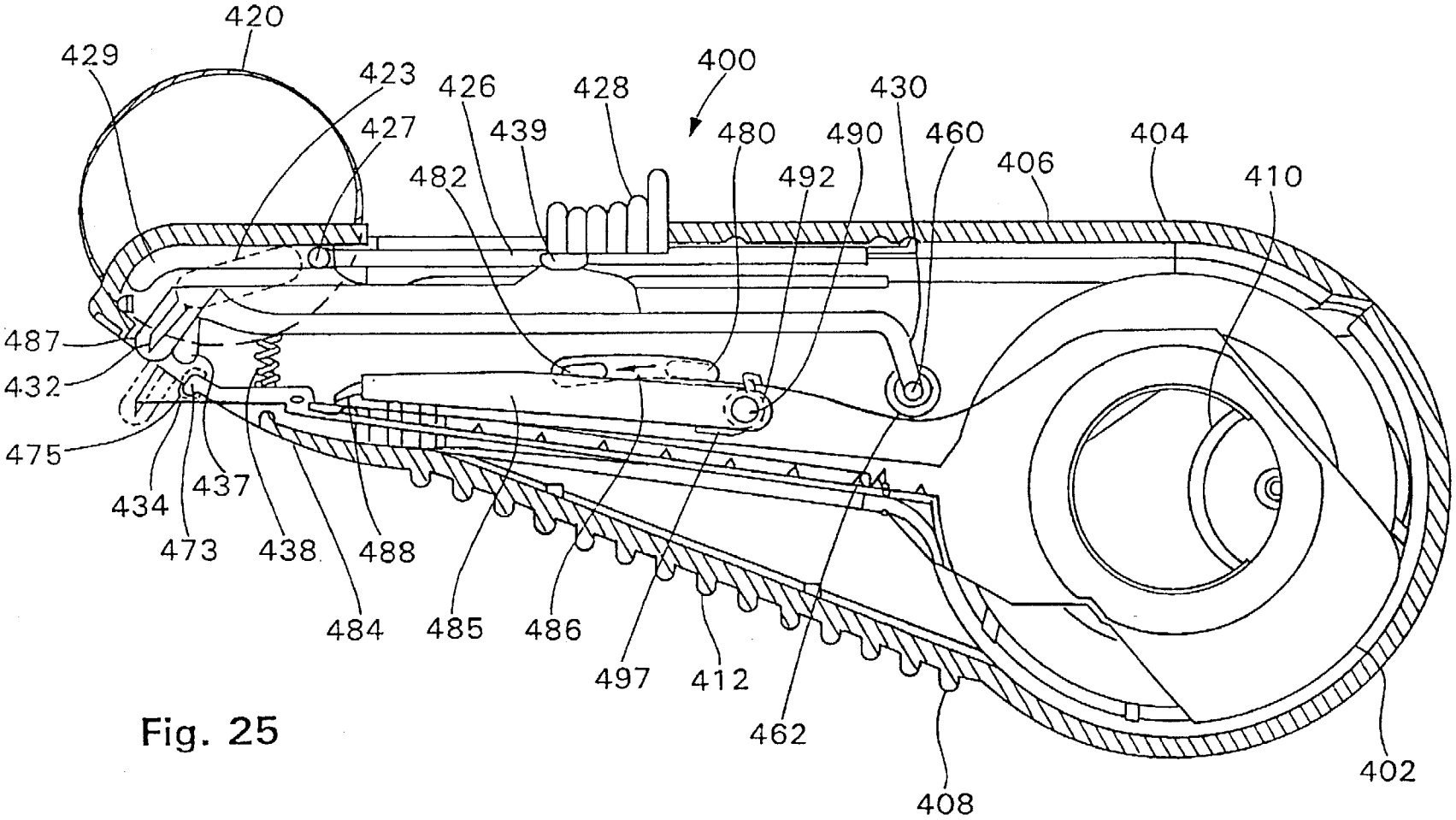
FIG. 25 is a cross-sectional view similar to FIG. 21 of a fourth embodiment of the invention.
Figure 26:
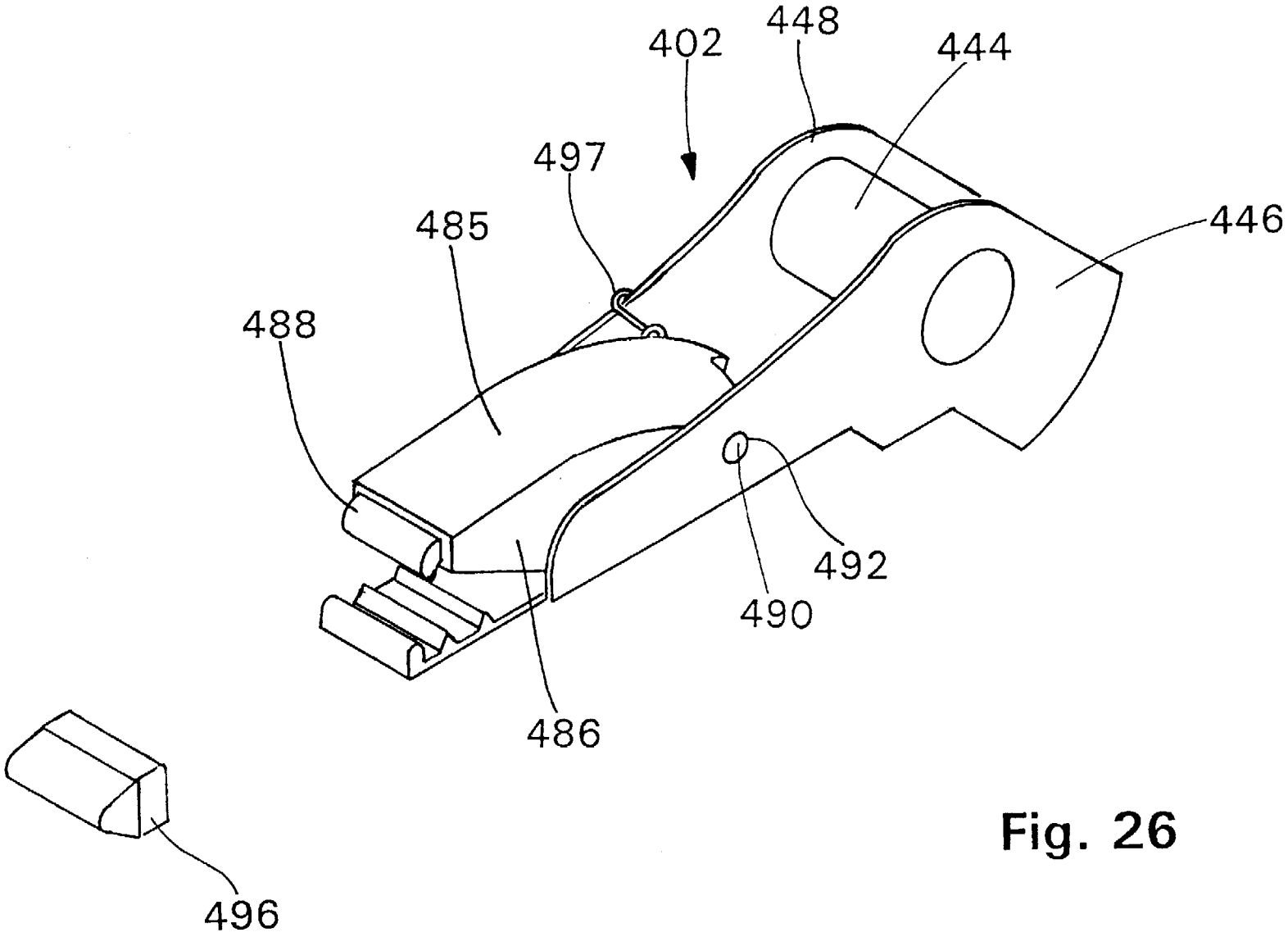
FIG. 26 is a perspective view of the tape cartridge in accordance with the fourth embodiment of the invention.

Referring now to FIGS. 25 and 26, a fourth embodiment 400 of a tape applicator is shown. The fourth embodiment 400 is similar to the third embodiment, and similar elements have been designated with similar reference numerals having the with the hundreds digit being "4" instead of "3". For example, the shell 404 of the fourth embodiment of the tape applicator 400 is similar to the shell 304 of the third embodiment of the applicator 300, except for the differences noted in detail below.

The fourth applicator 400 includes a support arm 430 for the blade 432 which is located adjacent to the slider 426, in order to provide a larger space for the tape cartridge 402. The second end of the support arm 432 includes a pivot pin 460 which is pivotally mounted in aligned bores 462 in the sides of the shell 404. A coil spring 438 is used to bias the support arm 430 upward such that the blade 432 is retracted in the shell 404. The cover 420 is opened and the blade 432 is extended from the shell 404 to the cutting position (shown in phantom lines) utilizing the button 428 in the same manner as described in conjunction with the third applicator 300.

In the fourth embodiment 400, a burnisher 473 is provided, and a burnishing clip 475 is attached over the burnisher 475. The burnishing clip 475 is made of a resilient material having a medium to soft durometer to burnish the tape as it is applied.

As shown in FIG. 25, a slot 480 is provided in the shell 404, and a marker actuator lever 482 is slidable located in the slot 480. A marker or highlighter 485 having an ink reservoir 486 and a tip 488 is provided on the tape cartridge 402. Pivot pins 490 are affixed to the marker casing and are pivotably located in complementary holes 492 in the sides 446, 448 of the tape cartridge 402, as shown in FIGS. 23 and 24. The marker actuator lever 482 is movable from a first position (shown in phantom lines in FIG. 23) to a second position as shown, to force the tip 488 of the marker 485 into contact with the tape 434. Preferably, a second resilient member 497 is provided for biasing the marker 485 to a first position (shown in phantom lines) where the tip 488 is not in contact with the tape 434. Preferably, the second resilient member 497 is a torsion spring having a first leg which contacts the marker 485 and a second leg which is affixed to a sidewall 446 or 448 of the tape cartridge 402.

Referring now to FIG. 26, the tape cartridge 402 includes two sides 446 and 448. A cylindrical roll 444 is located between the sides 446, 448 for supporting a roll of tape and the marker 485. Preferably, a removable cap 496 is provided for the marker to prevent the ink from drying out. In the preferred embodiment, the cap 496 is removed prior to using the applicator 400 by opening the door 408 from the shell 404. However, it will be understood by those skilled in the art from the present disclosure that the cap 496 could be automatically removed as the lever 482 is actuated by an appropriate linkage, if desired.

The tape 434 is dispensed and applied in the same manner as noted above in connection with the previous embodiments. The marker 485 can be used to color all or part of the tape 434 as it is being applied. Preferably, the tip 488 of the marker 485 is as wide as the tape 434. However, it will be recognized by those skilled in the art from the present disclosure that the marker tip 488 could be half as wide as the tape 434 and color only half the width of the tape 434, or any other fraction thereof. It will be similarly recognized that the marker 485 could be replaced with a similarly sized glue applicator to apply an adhesive to the second side of the tape 434.

It should now be appreciated that the practice of the present invention provides for an applicator that not only is easily manipulated, safeguards its tape against contaminants, but also allows for easy replacement of its associated tape.

While several preferred embodiments of the present invention have been disclosed, and modifications thereof suggested, it will be recognized by those skilled in the art that still other changes could be made to the above-identified embodiments of the invention without departing from the broader concepts thereof. It should be understood, therefore, that the invention is not limited to the particular embodiments disclosed, but is intended to cover the modifications which are within the scope and spirit of the present invention.

We claim:

1. An applicator for dispensing tape, the tape having an adhesive on at least one face thereof, the applicator comprising:

(a) a shell having opposite sides, a first end and a second end, the first end including an open region and a first slot;

(b) a door pivotably attached to the shell;

(c) a tape cartridge removably located on the door, the cartridge including means for rotatably supporting a roll of the tape, wherein a leading edge of the tape extends outwardly from the roll;

(d) a cover member having an open portion and a closed portion, the cover member being connected to the first end of the shell for pivotable movement thereabout along a predetermined path;

(e) a slider having a first end which is pivotally connected to the cover member and having a button which extends through the first slot in the shell, a cutter actuator being located on the slider inside the shell, the slider being slidably attached to the shell for sliding movement between a first position, in which the cover member covers the open region of the shell, and a second position, in which the cover member is spaced from the open region, and the cutter actuator is movable in response to pressure applied to the button;

(f) a cutting tool having a support arm with a first end which supports a cutting instrument and a second end which is pivotally connected to the shell, and a resilient member which biases the support arm to a first position in which the cutting instrument is retracted in the shell, the cutting instrument being movable from the first position to a second position by the application of pressure to the button on the slider such that the cutter actuator moves the support arm and the cutting instrument extends through the open region of the shell.

2. The applicator of claim 1 wherein the cutting instrument is located directly on the first end of the support arm.

3. The applicator of claim 1 wherein the resilient member is formed integrally with the support arm.

4. The applicator of claim 1 wherein the resilient member is a coil spring.

5. The applicator of claim 1 wherein a marker is pivotally attached to the cartridge, the marker including a fluid reservoir and a tip, the marker being movable from a non-marking position, wherein the tip is located above the tape, to a marking position, wherein the tip is in contact with the tape.

6. The applicator of claim 5 wherein a second slot is located in the shell, and a marker actuator lever is slidably disposed in the second slot, the marker actuator lever being movable from a first position, wherein the marker is in the non-marking position with the tip being located above the tape, to a second position, to force the tip into contact with the tape.

7. The applicator of claim 5 further comprising a second resilient member for biasing the marker to the non-marking position.

8. The applicator of claim 5 wherein the marker tip has a width which is approximately equal to a width of the tape.

9. The applicator of claim 5 wherein the marker tip has a width which is less than a width of the tape.

10. The applicator of claim 1 wherein the door includes two sides, and rails are located on each of the two sides to form slots for receiving the tape cartridge, and the cartridge includes sidewalls of a complementary size to the slots such that the tape cartridge is received in the slots.

11. The applicator of claim 1 wherein the tape cartridge includes a tongue having plurality of spaced-apart bumps located thereon for supporting the adhesive face of the tape.

12. The tape applicator of claim 1 further comprising a window located in one side of the shell in proximity to the roll of tape.

13. The tape applicator of claim 1 further including a burnishing bump located on the shell adjacent to the open region for applying pressure on the tape as the tape is being applied.

14. The tape applicator of claim 1 wherein the means for supporting a roll of tape further include a brake to prevent the roll of tape from unwinding.

15. The tape applicator of claim 1 further comprising at least one cutter guard located adjacent to the cutting instrument, the cutting instrument being spaced inwardly from an edge of the cutter guard.

16. An applicator for dispensing tape, the tape having an adhesive on at least one face thereof, the applicator comprising:

(a) a shell having opposite sides, a first end and a second end, the first end including an open region and a first slot;

(b) a door pivotably attached to the shell;

(c) a tape cartridge located on the door, the cartridge having a tape roll support, a leading edge of the tape extending outwardly from the roll;

(d) a cover member having an open portion and a closed portion, the cover member being connected to the first end of the shell for pivotable movement thereabout along a predetermined path;

(e) a slider having a first end which is pivotally connected to the cover member and having a button which extends through the first slot in the shell, a cutter actuator being located on the slider inside the shell, the slider being slidably attached to the shell for sliding movement between a first position, in which the cover member covers the open region of the shell, a second position, in which the cover member is spaced from the open region, and a third position, in which the cutter actuator is movable in response to pressure applied to the button;

(f) a cutting tool having a support arm with a first end which supports a cutting instrument and a second end being pivotally connected to the shell, and a resilient member which biases the support arm to a first position in which the cutting instrument is retracted in the shell, the cutting instrument being movable from the first position to a second position by the application of pressure to the button on the slider such that the cutter actuator moves the support arm, and the cutting instrument extends through the open region of the shell.

17. The applicator of claim 16 wherein a marker is pivotally attached to the cartridge, the marker including a fluid reservoir and a tip, the marker being movable from a non-marking position, wherein the tip is located above the tape, to a marking position, wherein the tip is in contact with the tape.

18. The applicator of claim 16 wherein the door includes two sides, and rails are located on each of the two sides to form slots for receiving the tape cartridge, and the cartridge includes sidewalls of a complementary size to the slots such that the tape cartridge is received in the slots.

19. The tape applicator of claim 16 further including a burnishing bump located on the shell adjacent to the open region for applying pressure on the tape as the tape is being applied.

20. The tape applicator of claim 16 further comprising at least one cutter guard located adjacent to the cutting instrument, the cutting instrument being spaced inwardly from an edge of the cutter guard.

* * * * *